US010086497B1

(12) United States Patent
Kivisto et al.

(10) Patent No.: US 10,086,497 B1
(45) Date of Patent: Oct. 2, 2018

(54) SUBMERSIBLE LIQUID JET APPARATUS

(71) Applicant: Chukar Waterjet, Inc., St. Michael, MN (US)

(72) Inventors: Bruce Kivisto, Cokato, MN (US); Amandeep Singh, Houston, TX (US); Gordon A. Bekkala, Cokato, MN (US); Jude J. Lague, Maple Plain, MN (US)

(73) Assignee: Chukar Waterjet, Inc., St. Michael, MN (US)

( * ) Notice: Subject to any disclaimer, the term of this patent is extended or adjusted under 35 U.S.C. 154(b) by 0 days.

(21) Appl. No.: 13/872,943

(22) Filed: Apr. 29, 2013

Related U.S. Application Data

(60) Provisional application No. 61/639,592, filed on Apr. 27, 2012.

(51) Int. Cl.

| | |
|---|---|
| ***B24C 3/32*** | (2006.01) |
| ***B24C 7/00*** | (2006.01) |
| ***B24C 3/06*** | (2006.01) |
| ***B24C 11/00*** | (2006.01) |
| ***B24C 5/08*** | (2006.01) |

(52) U.S. Cl.
CPC ..... *B24C 3/06* (2013.01); *B24C 3/32* (2013.01); *B24C 5/08* (2013.01); *B24C 7/0007* (2013.01); *B24C 11/00* (2013.01)

(58) Field of Classification Search
CPC ..... B24C 3/32; B24C 7/0007; B24C 7/00; B24C 11/00; B24C 11/005; B63B 57/02; B63B 59/08
USPC ..... 451/38–40, 75, 99
See application file for complete search history.

(56) References Cited

U.S. PATENT DOCUMENTS 2,612,732 A * 10/1952 Ziegler ..... 451/99
2,985,050 A * 5/1961 Schwacha ..... B26F 3/004 125/23.01
3,032,929 A * 5/1962 Glesener ..... B24C 3/06 451/90
3,084,484 A * 4/1963 Hall ..... B24C 7/0046 291/3
3,256,642 A * 6/1966 Fonti ..... B24C 5/02 451/90
3,311,553 A * 3/1967 Weiss ..... C09K 8/05 507/145
3,323,257 A * 6/1967 Fonti ..... 451/75
3,626,841 A * 12/1971 Schachter ..... B24C 7/0061 451/90
3,852,200 A * 12/1974 Meyer ..... E21B 7/18 175/65
4,163,455 A * 8/1979 Hebert ..... B63B 57/02 114/222
4,329,448 A * 5/1982 Cox ..... A61K 8/73 424/49

(Continued)

*Primary Examiner* — Joseph J Hail
*Assistant Examiner* — Arman Milanian
(74) *Attorney, Agent, or Firm* — Haugen Law Firm PLLP

(57) ABSTRACT

A submersible liquid jet apparatus is provided for a system with a portable liquid jet tool that may be handled by human divers or remotely operated vehicles (ROV). The present apparatus facilitates the portability of a liquid jet tool with a support unit supplying high pressure working liquid and pressurized hydraulic fluid. The apparatus further provides portable delivery of an abrasive suspension to enhance the effectiveness of the high pressure working liquid.

3 Claims, 23 Drawing Sheets

(56) References Cited

U.S. PATENT DOCUMENTS 4,380,138 A * 4/1983 Hofer ..... B24C 5/00 451/40
4,404,107 A * 9/1983 Cowan ..... C09K 8/035 162/6
4,449,332 A 5/1984 Griffiths
4,478,368 A * 10/1984 Yie ..... B05B 7/1431 239/430
4,545,317 A * 10/1985 Richter ..... B05B 7/1486 114/222
4,555,872 A * 12/1985 Yie ..... B05B 7/1431 451/102
4,569,160 A * 2/1986 Hengesbach ..... B24C 3/06 451/90
4,629,575 A * 12/1986 Weibel ..... C09K 8/206 106/162.9
4,854,090 A * 8/1989 Heron ..... B24C 7/0007 451/101
5,115,600 A * 5/1992 Kataoka ..... B24B 53/007 125/11.01
5,178,496 A 1/1993 Trieb et al.
5,184,434 A * 2/1993 Hollinger ..... B24C 7/0007 451/36
5,209,254 A 5/1993 Chapman et al.
5,265,634 A 11/1993 Chapman et al.
5,273,405 A 12/1993 Chalmers et al.
5,363,603 A 11/1994 Miller et al.
5,605,497 A * 2/1997 Pickard ..... B24C 7/0053 239/379
5,679,058 A 10/1997 Rhoades
5,851,139 A 12/1998 Xu
5,852,076 A 12/1998 Serafin et al.
5,921,846 A 7/1999 Katz
5,947,800 A * 9/1999 Fring ..... B24C 7/0046 451/101
5,971,835 A * 10/1999 Kordonski ..... B24C 3/18 451/36
6,089,955 A * 7/2000 Rolle ..... A62D 3/33 451/38
6,200,203 B1 3/2001 Xu et al.
6,220,529 B1 4/2001 Xu
6,793,563 B2 * 9/2004 Daniel ..... B24C 5/02 451/90
6,955,585 B2 * 10/2005 Mitsuishi ..... B24C 1/04 451/36
7,033,256 B2 4/2006 Miller
7,094,135 B2 8/2006 Chisum et al.
7,108,585 B1 9/2006 Dorfman et al.
7,186,167 B2 3/2007 Joslin
7,485,027 B2 2/2009 Miller
2003/0109206 A1 * 6/2003 Anand ..... B24C 1/045 451/90
2007/0105486 A1 * 5/2007 Benson ..... B24C 7/0007 451/38
2010/0298174 A1 * 11/2010 Tehrani et al. ..... 507/104
2012/0156969 A1 * 6/2012 Liu ..... B24C 5/02 451/40
2012/0196516 A1 * 8/2012 Funatsu ..... B24C 1/00 451/89
2014/0213150 A1 * 7/2014 Schubert ..... B24C 9/00 451/38

* cited by examiner

SUBMERSIBLE LIQUID JET APPARATUS

CROSS-REFERENCE TO RELATED APPLICATIONS

This application claims priority to U.S. Provisional Patent Application Ser. No. 61/639,592, filed on Apr. 27, 2012 and entitled "SYSTEM FOR DISPENSING ABRASIVE SUSPENSION IN A LIQUID JET APPARATUS," the content of which being incorporated herein in its entirety.

FIELD OF THE INVENTION

The present invention relates to liquid jet cutting and surface modification apparatus generally, and more particularly to an abrasive and abrasive delivery system for such liquid jet apparatus, as well as a deployment system for subsea application of such liquid jet apparatus. The present arrangement facilitates the introduction of abrasive particles into the ultra high pressure liquid forming the liquid jet, and specifically a system that facilitates portability of the liquid jet tool for use upon work pieces not easily accessible by conventional liquid jet apparatus.

BACKGROUND OF THE INVENTION

High pressure liquid is frequently utilized in operations for forming cuts in hard or brittle material, and also for the formation of cuts involving unusual or difficult-to-machine patterns. Water jets of ultra high pressure (>55,000 psi) have been used effectively to cut materials that are otherwise cut with knives, shears, or saws. Entrainment of abrasive particles in the water jets permits cutting of hard materials such as steel, concrete, and lightweight composites.

Abrasive particles are typically entrained in the water jet after the jet is formed by an orifice, and prior to ejection from a nozzle. Abrasive delivery systems perform the function of storing and conveying the abrasive particles over varying distances from the storage site for introduction to the jet. Conventional abrasive delivery systems impose a driving force upon dry abrasive particles through the use of a pneumatic drive. Such systems, however, may be prone to clogging and other delivery problems, and further require gas pressurization systems to propel the abrasive particles through the abrasive delivery conduits. Conventional abrasive delivery systems also typically utilize relatively large dry abrasive particle reservoirs, and employ significant mechanics in the delivery of the abrasive to the liquid jet tool. Such convention approach limits the applicability of liquid jet apparatus in cutting and surface treating work pieces in the field.

There is accordingly a need for a portable liquid jet apparatus that employs an abrasive dispensing system that consistently dispenses an abrasive flow rate into the liquid jet.

There is also a need for portable liquid jet systems to be used in a submerged environment, for operating on underwater work pieces such as pipelines, structural supports, and sunken wreckage.

There is accordingly a further need for portable liquid jet systems that are capable of operating in a submerged condition, including in sea water environments at significant depths.

In certain applications, portable liquid jet systems may be facilitated with portable supplies of abrasive material, including within operating environments wherein pneumatic drive systems are unavailable, ineffective, or unsuitable.

Another need in the art is therefore a system and apparatus for the portable delivery of abrasives to a liquid jet tool, wherein such delivery is independent of pneumatic drive systems.

SUMMARY OF THE INVENTION

By means of the present invention, cutting and other surface modification functions may be performed at submerged locations, including at substantial underwater depths, by a liquid jet tool. Moreover, the submersible liquid jet tool is sufficiently portable to be operated and transported by a human diver or a conventional remotely operated vehicle (ROV). The portable liquid jet tool may be supplied with high pressure working liquid and pressurized hydraulic fluid from a submersible support unit through respective conduits, thereby enabling a wide range of movement of the submersible liquid jet tool with respect to the submersible support unit.

To enhance the effectiveness of the submersible liquid jet tool, an abrasive suspension may be supplied in a portable manner to the tool. Aliquots of abrasive suspension may be contained in a portable dispensing apparatus that is transportable by a human diver or an ROV. The portable dispensing apparatus may be positioned at or in proximity to the liquid jet tool, so that abrasive suspension may be directly drawn into a discharge chamber of the tool as a consequence of a reduced pressure developed in the discharge chamber by passage of highly pressurized raw working liquid out from the tool.

The abrasive suspension itself may be specifically adapted for dispensation in a high external pressure submerged environment, and primarily under the force of a pressure differential between the abrasive suspension storage vessel and a discharge chamber in the liquid jet tool.

In one embodiment, a submersible liquid jet tool system of the present invention includes a liquid jet tool capable of emitting a liquid jet up to and exceeding 55,000 psi through an orifice, and a submersible support unit that is capable of operating underwater at an external water pressure of up to and exceeding 5,000 psi. The support unit includes an intensifier for generating a pressurized working liquid supply at a pressure of at least 1,000 psi, a first hydraulic pump for hydraulically operating the intensifier, and a pressurized hydraulic fluid supply. A working liquid supply conduit is provided for supplying the liquid jet tool with the pressurized working liquid, and a hydraulic fluid supply conduit is provided for supplying the liquid jet tool with the pressurized hydraulic fluid, so that the liquid jet tool may be operated remotely from the submersible support unit.

In another embodiment, a submersible liquid jet tool system of the present invention includes a liquid jet tool capable of emitting a working liquid jet exceeding 55,000 psi through an orifice, a portable dispensing apparatus having a spout and a storage vessel containing a fluid, and a conveyance coupling apparatus secured to or in proximity to the liquid jet tool. Installation of the portable dispensing apparatus to the conveyance coupling apparatus fluidly communicates the storage vessel to the liquid jet tool for pressurized emission of the fluid.

An abrasive suspension for use in a liquid jet tool includes abrasive particles having a particle size of 30-220 grit, water, a suspension agent including a clay, and a rheology modifying agent that is present in the abrasive suspension in a concentration ratio to the suspension agent that is determined by:

$$R=(x)*S$$

Wherein:

R=weight of the rheology modifying agent;

x=3-10%

S=weight of suspension agent.

A method for dispensing an abrasive suspension includes providing a storage vessel containing the abrasive suspension, wherein the abrasive suspension includes abrasive particles, a suspension agent including a clay, a thixotropic rheology modifying agent, a lignosulfinate, and water. The method further includes fluidly connecting the storage vessel to a chamber of a liquid jet tool, wherein the liquid jet tool operably creates a reduced pressure in the chamber that is effective to draw the abrasive suspension through the fluid connection to the chamber.

DETAILED DESCRIPTION OF THE PREFERRED EMBODIMENTS

Figure 1:
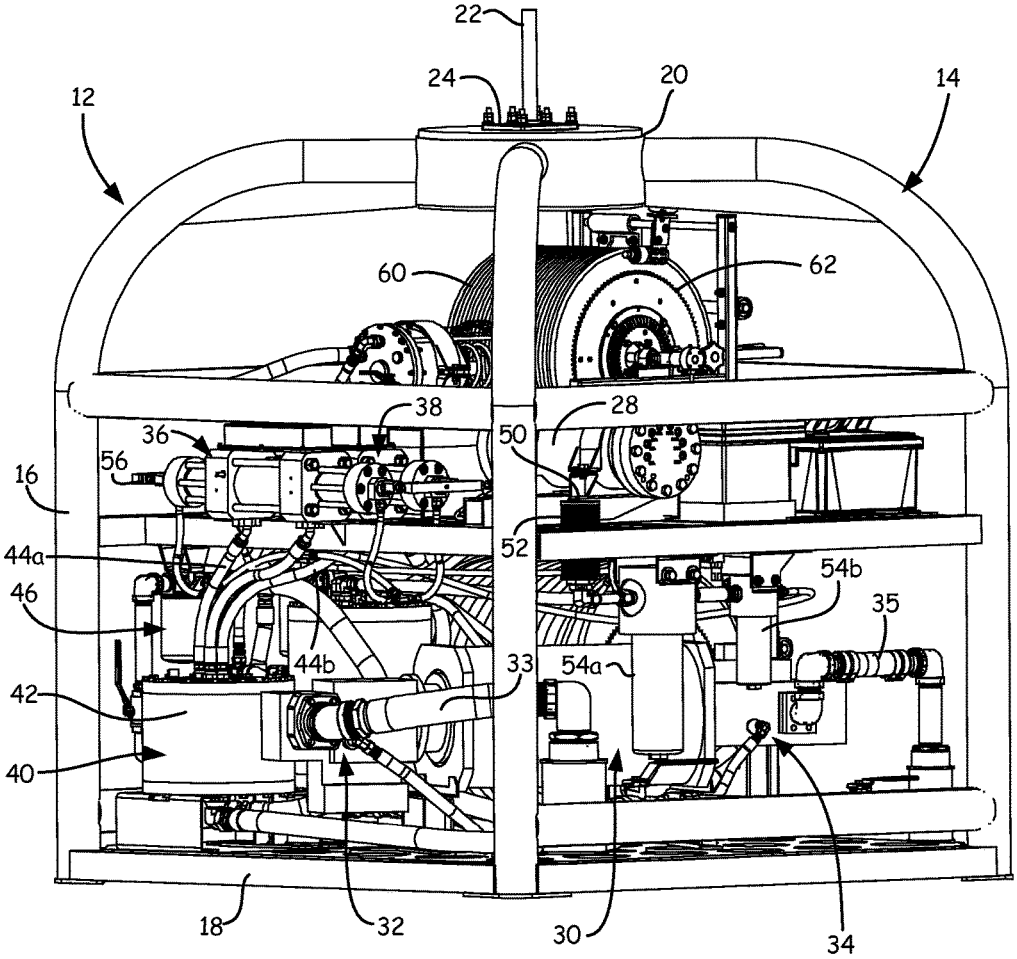
FIG. 1 is a schematic perspective view of a portion of the apparatus of the present invention.
Figure 2:
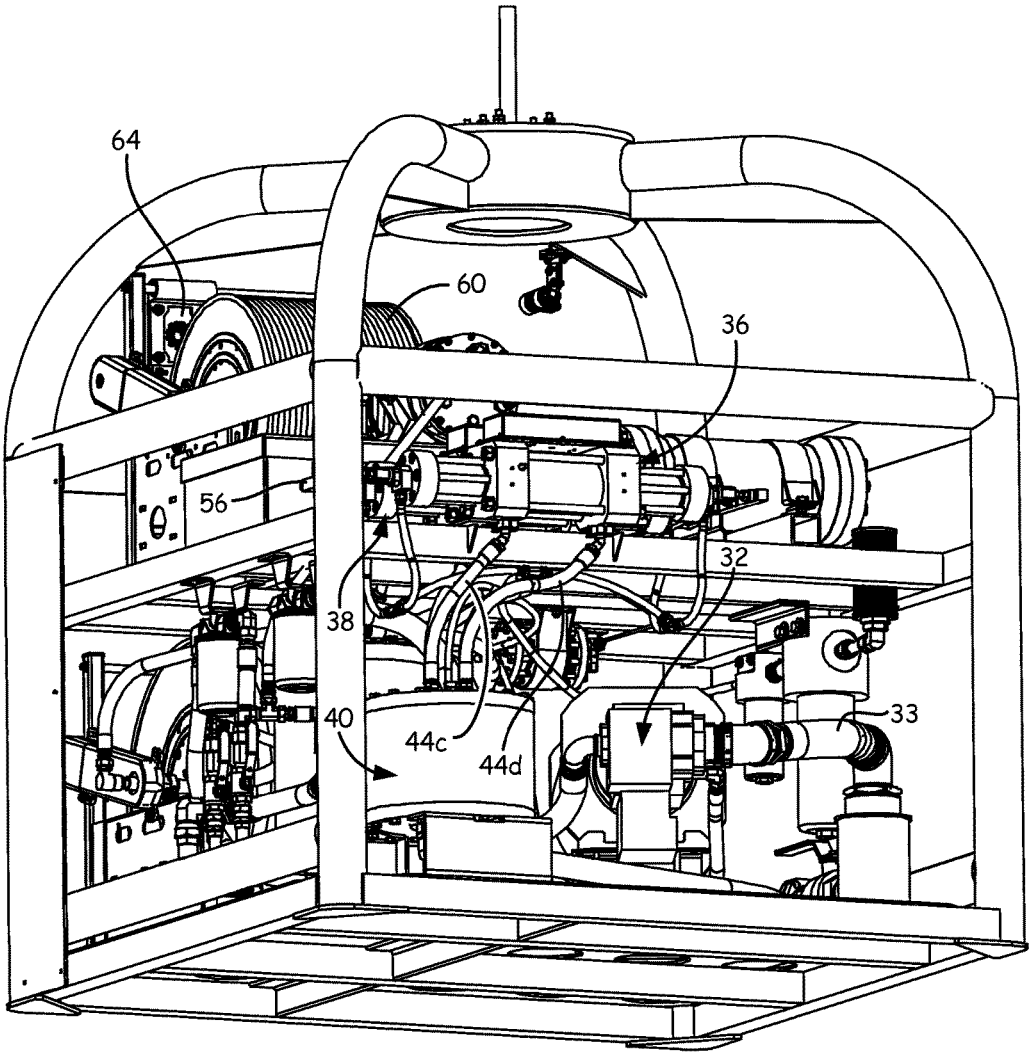
FIG. 2 is a schematic perspective view of a portion of the apparatus of the present invention.
Figure 3:
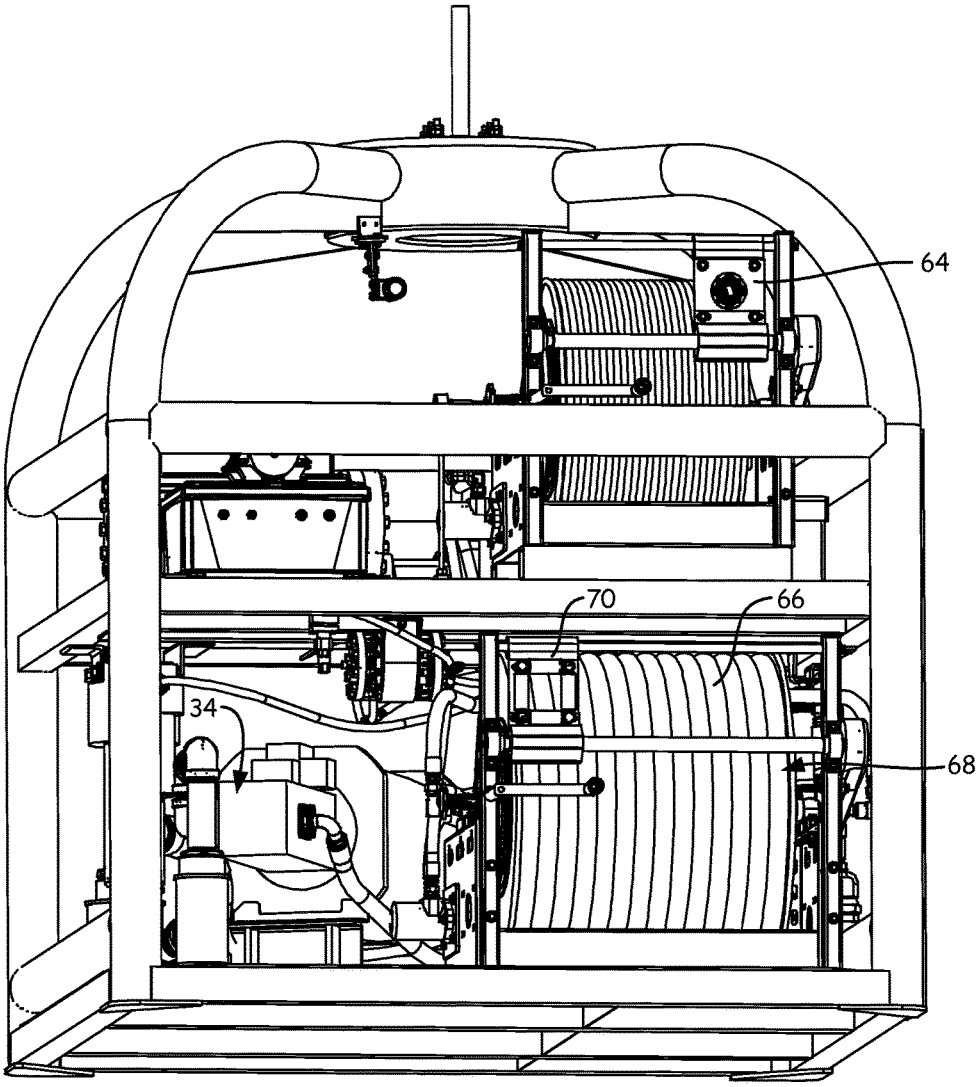
FIG. 3 is a schematic perspective view of a portion of the apparatus of the present invention.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "front", "rear", "vertical", "horizontal", "top", "bottom" and the like are intended to be relative to the orientation of a particular embodiment of the invention as shown in the figures. In addition, a given reference numeral in the drawings indicates the same or similar structure when it appears in different figures, and like reference numerals identify similar structural elements and/or features of the subject invention.

With reference now to the drawing figures, a portable liquid jet support unit 12 includes the components necessary to support the operation of a liquid jet tool, and particularly a portable liquid jet tool operable in underwater environments. For the purposes of underwater operation, the components of support unit 12 may be manufactured from marine-grade and corrosion-resistant materials, and may be appropriately sealed to prevent undesired water intrusion. In some applications, support unit 12 may be specifically adapted for use at substantial underwater depths, including within saline environments at depths up to, and possibly exceeding, three thousand meters below the water surface. To accommodate operation at such depths, provisions are incorporated in support unit 12 to withstand external fluid pressures exceeding 5,000 psi. For the purposes hereof, the term "withstand external fluid pressures exceeding 5,000 psi" is intended to mean materials, joints, and seals which prevent undesired environmental water influx, maintaining intended physical characteristics, and maintaining desired operational characteristics in an underwater environment, including at external fluid pressures up to and exceeding 5,000 psi.

Support unit 12 includes a frame 14 having frame members 16 and a base 18. Frame 14 may be fabricated from stainless steel or any other marine-grade, corrosion-resistant material. Aluminum is another example material for its low relative density, its strength, and corrosion-resistance properties. In some embodiments, frame members 16 may be substantially hollow, and may therefore serve as individual and/or interconnected fluid reservoirs for hydraulic fluid, such as oil, used in the components of support unit 12 and/or the liquid jet tool. In the illustrated embodiment frame 14 includes a connection platform 20 at which various connection implements may be mounted for deploying support unit 12. An "umbilical" cable 22 may be secured at connection platform 20 through a connection bracket 24 for lifting and lowering support unit 12. The illustrated embodiment of support unit 12 exemplifies a submersible structure, wherein a crane, winch, or other mechanism at the water surface (such as that mounted on a ship, platform, or the like) may hoist or lower support unit 12 through the manipulation of umbilical cable 22. To lower support unit 12 into the water, for example, the crane or winch may unwind a length of umbilical cable 22 from a reel, and may likewise hoist support unit 12 through a winding action of the umbilical cable 22 about the reel.

Umbilical cable 22 may further define a channel through which electrical power lines and data communication lines may extend, such that support unit 12 may be remotely provided with electrical energy and data communication signals. Fiber optic lines may be employed for communications transmission to control system 26, which may be disposed within a dry-sealed vessel 28 that is capable of maintaining a dry interior chamber at external fluid pressures of up to about 5,000 psi. Other fiber optic lines may be employed to communicate signals to/from a video camera mounted at support unit 12. Electrical energy may be delivered through umbilical cable 22 with a three-phase electrical cable.

Control system 26 is programmed to controllably operate motor 30, which drives the hydraulic pumps of support unit 12, including first and second hydraulic pumps 32, 34. Motor 30 may, in some embodiments, be an electric motor supplied with electrical power through the electrical lines extending through the channel of umbilical cable 22. An example electric motor 30 may operate at 3,000 V (52 Amp) to generate up to about 100 hp. First hydraulic pump 32 may be adapted to develop about 3,000 psi hydraulic pressure to drive the operation of first and second intensifiers 36, 38. First hydraulic pump 32 may have a 180 cc/revolution displacement, and be supplied with hydraulic fluid from the hydraulic fluid reservoirs through hydraulic supply line 33. Second hydraulic pump 34 may be adapted to supply pressurized hydraulic fluid to about 3,000 psi at 140 liters/min. for the operation of the liquid jet tool, which may be located remotely from support unit 12, as well as the hydraulically-operated hose reels. Hydraulic supply line 35 may supply second hydraulic pump 34 with hydraulic fluid from the hydraulic fluid reservoir.

First and second intensifiers 36, 38 generate an output of ultra high pressure liquid of up to, and possibly exceeding, 55,000 psi at a flow rate of about 2 gallons per minute. Other intensifier specifications, however, may be employed in support unit 12 of the present invention. First and second intensifiers 36, 38 are available from Jet Edge, Inc. of St. Michael, Minn. Example intensifiers, related components, and liquid jet dispensers, nozzles, and tools useful in the present invention are described in U.S. Pat. Nos. 5,092,744; 5,052,624; 5,019,670; 4,937,985; 5,273,405; 5,851,139; and 6,220,529, the contents of which being incorporated herein by reference.

Figure 23:
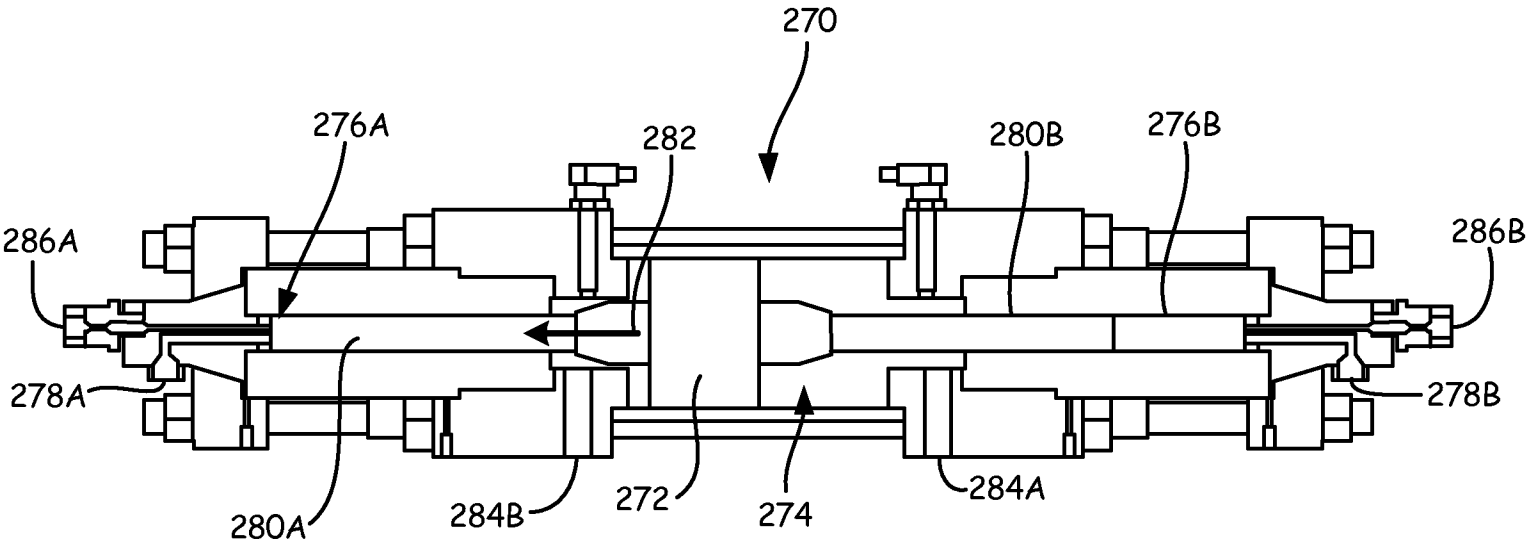
FIG. 23 is a cross-sectional schematic view of a portion of the apparatus of the present invention.
Figure 24:
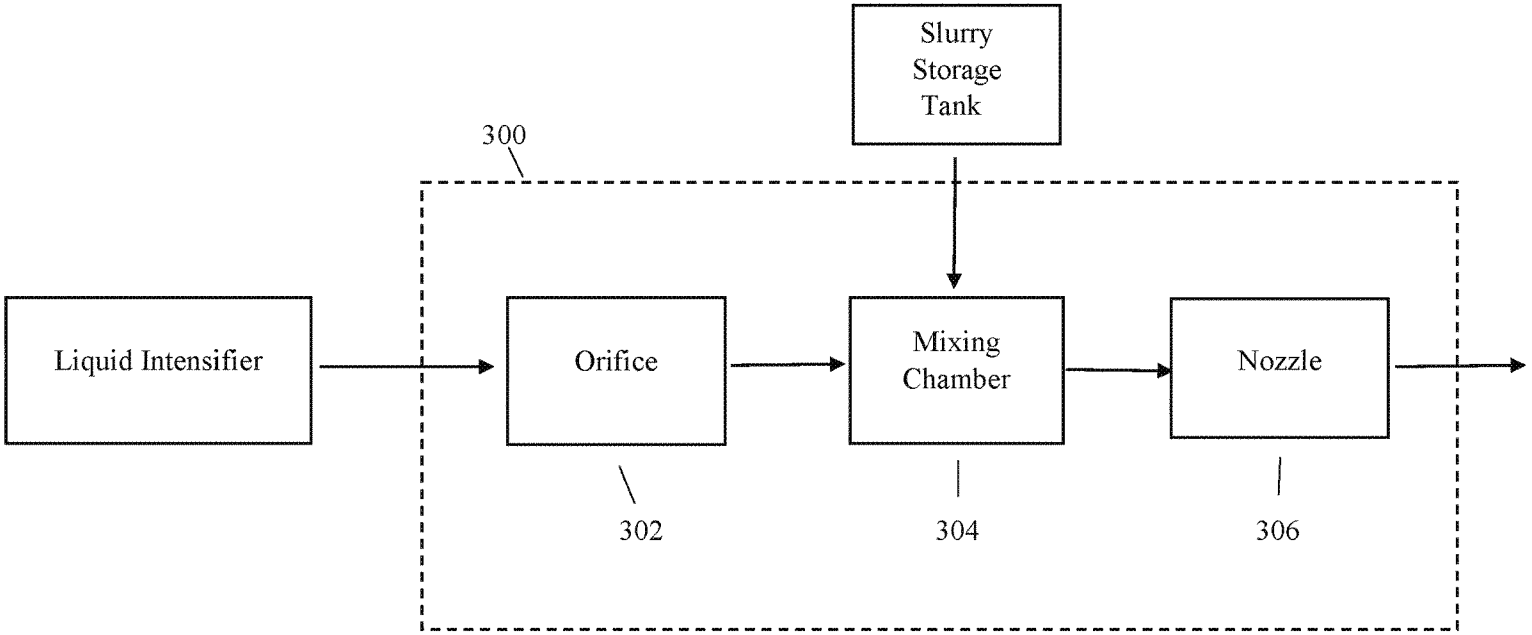
FIG. 24 is a schematic illustration of the apparatus of the present invention.

A schematic diagram of an example intensifier is depicted in FIG. 23, wherein a hydraulically driven piston 272 inside the intensifier 270 shifts from one side to another within a hydraulic cylinder 274 to pressurize the low pressure supply liquid into ultra high pressure liquid. Low pressure supply liquid is supplied to respective first and second pressure cylinders 276A, 276B through corresponding low pressure liquid inlets 278A, 278B. Piston 272 is secured to first and second plungers 280A, 280B, which extend into respective pressure cylinders 276A, 276B to alternately pressurize/depressurize pressure cylinders 276A, 276B with the reciprocal hydraulically-driven movement of piston 272 within hydraulic cylinder 274.

The movement of piston 272 along direction arrow 282 in FIG. 23 is driven by hydraulic fluid delivered to hydraulic cylinder 274 through a first hydraulic orifice 284A. The pressurized hydraulic fluid exerts a force upon piston 272 to move in a direction along direction arrow 282, with such movement being permitted by the drainage of hydraulic fluid through second hydraulic fluid orifice 284B. Movement of piston 272 along direction 282 drives first plunger 280A further into pressure cylinder 276A to pressurize liquid within first pressure cylinder 276A. Such pressurized liquid is emitted from intensifier 270 at first high pressure liquid outlet 286A. At a designated point along the travel of piston 272, hydraulic supply line valves are appropriately actuated to begin supply of pressurized hydraulic fluid into hydraulic cylinder 274 through second hydraulic fluid orifice 284B, and to correspondingly permit drainage of hydraulic fluid from hydraulic cylinder 274 through first hydraulic fluid orifice 284A. Piston 272 is then forced along an opposite direction to pressurize liquid within second pressure cylinder 276B for high pressure liquid outlet at second outlet 286B. Withdrawal of first plunger 280A from its position in first pressure cylinder 276A creates a reduced pressure within pressure cylinder 276A, to thereby draw liquid into pressure cylinder 276A through first low pressure liquid inlet 278A. Thus, while one high pressure cylinder 276A, 276B is pressurizing the liquid, the other high pressure cylinder 276A, 276B fills with new liquid.

First and second intensifiers 36, 38 may be controllably hydraulically operated through pressurized hydraulic fluid controllably delivered thereto from hydraulic valve pack 40 disposed in valve vessel 42 that is configured to maintain a dry interior chamber in the presence of external fluid forces of up to, and possibly exceeding, 5,000 psi. Pressurized hydraulic fluid flow management through intensifier hydraulic lines 44*a*-44*d* is controlled by hydraulic valve pack 40, which itself operates under the direction of control system 26. Pressurized hydraulic fluid controllably drives the direction of the respective plungers within first and second intensifiers 36, 38 which generate the ultra high pressure output. Electronic controls monitor the intensifier piston position and control a servo valve that operates the hydraulic piston in the intensifier. When the piston reaches the end of its stroke, the proximity sensor signals the servo valve to reverse the hydraulics to start the hydraulic piston on its opposite stroke. An example control system 26 for operating hydraulic valve pack 40 is described in our co-pending application claiming priority to U.S. provisional application Ser. No. 61/639,543, herein incorporated by reference.

Hydraulic system oil filters 46 may be employed at support unit 12 to maintain purity of the hydraulic fluid, and particularly for hydraulic fluid deliverable to the liquid jet tool.

The operation of first and second intensifiers 36, 38 generates a negative pressure on the expansion side of the moving intensifier plunger, which negative pressure draws liquid into the intensifiers. In the illustrated embodiment, arranged for submerged operation, a liquid inlet 50 is fluidly coupled to the intensifier chambers through appropriate valves, wherein environmental liquid passes through sieve 52 and through first and second filters 54*a*, 54*b*. Filtered liquid is then drawn into respective first and second intensifiers 36, 38 through appropriate valves. Ultra high pressure liquid output from first and second intensifiers 36, 38 is driven into a respective first or second output manifold 56, 58, and thereafter into ultra high pressure (UHP) hose 60 wound at a hydraulically-driven UHP hose reel 62. UHP hose 60 may be fabricated from an appropriate material, diameter, and wall thickness to convey ultra high pressure liquid at up to, and possibly exceeding, 55,000 psi. UHP hose 60 may be drawn through UHP hose guide bracket 64, and coupled to liquid jet tool for remote dispensation of the ultra high pressure liquid.

Second hydraulic pump 34 generates pressurized hydraulic fluid for use at the liquid jet tool. Delivery of the pressurized hydraulic fluid from second hydraulic pump 34 is provided by hydraulic fluid hose 66 wound at hydraulically-driven hydraulic fluid hose reel 38. Hydraulic fluid hose 66 is manufactured from a material with a diameter and wall thickness that is capable of conveying pressurized hydraulic fluid, as well as withstanding external fluid forces of up to, and possibly exceeding, 5,000 psi, while maintaining an open channel to convey the pressurized hydraulic fluid therethrough. Hydraulic fluid hose 66 may be drawn out from hydraulic fluid hose reel 68 through hydraulic fluid hose guide bracket 70, and fluidly coupled to the remote liquid jet tool. Pressurized hydraulic fluid facilitates the operation of various valves and other mechanisms at the liquid jet tool.

One aspect of portable liquid jet support unit 12 is the provision of a UHP hose and a hydraulic fluid hose to facilitate operation of a liquid jet tool remote from support unit 12. In some embodiments, it is contemplated that remotely operated vehicles (ROV) may operate the liquid jet tool remotely from support unit 12, but supplied with ultra high pressure liquid and pressurized hydraulic fluid from support unit 12. In such a manner, a substantial portion of the size and weight of a liquid jet system may be contained in a distinct unit 12, separate and apart from a mobile liquid jet tool carrier, such as an ROV or human user. The so-liberated liquid jet tool is therefore rendered substantially more portable than in conventional arrangements, and may be configured for use in a variety of applications inaccessible to conventional liquid jet systems. For example, the liquid jet tool may be hand-held by a human user, or may be incorporated with an apparatus for cutting and/or surface modifying pipelines from an interior disposition. Moreover, since support unit 12 may be capable of generating the ultra high pressure liquid and pressurized hydraulic fluid, on-board power resources of ROVs are conserved.

The liquid jet tool employed with the present invention is available from Jet Edge, Inc. of St. Michael, Minn. Example liquid jet tools and their components useful in the present invention are described in U.S. Pat. Nos. 5,092,744; 5,052,624; 5,019,670; 4,937,985; 5,273,405; 5,851,139; and 6,220,529, the contents of which being incorporated herein by reference.

Figure 4:
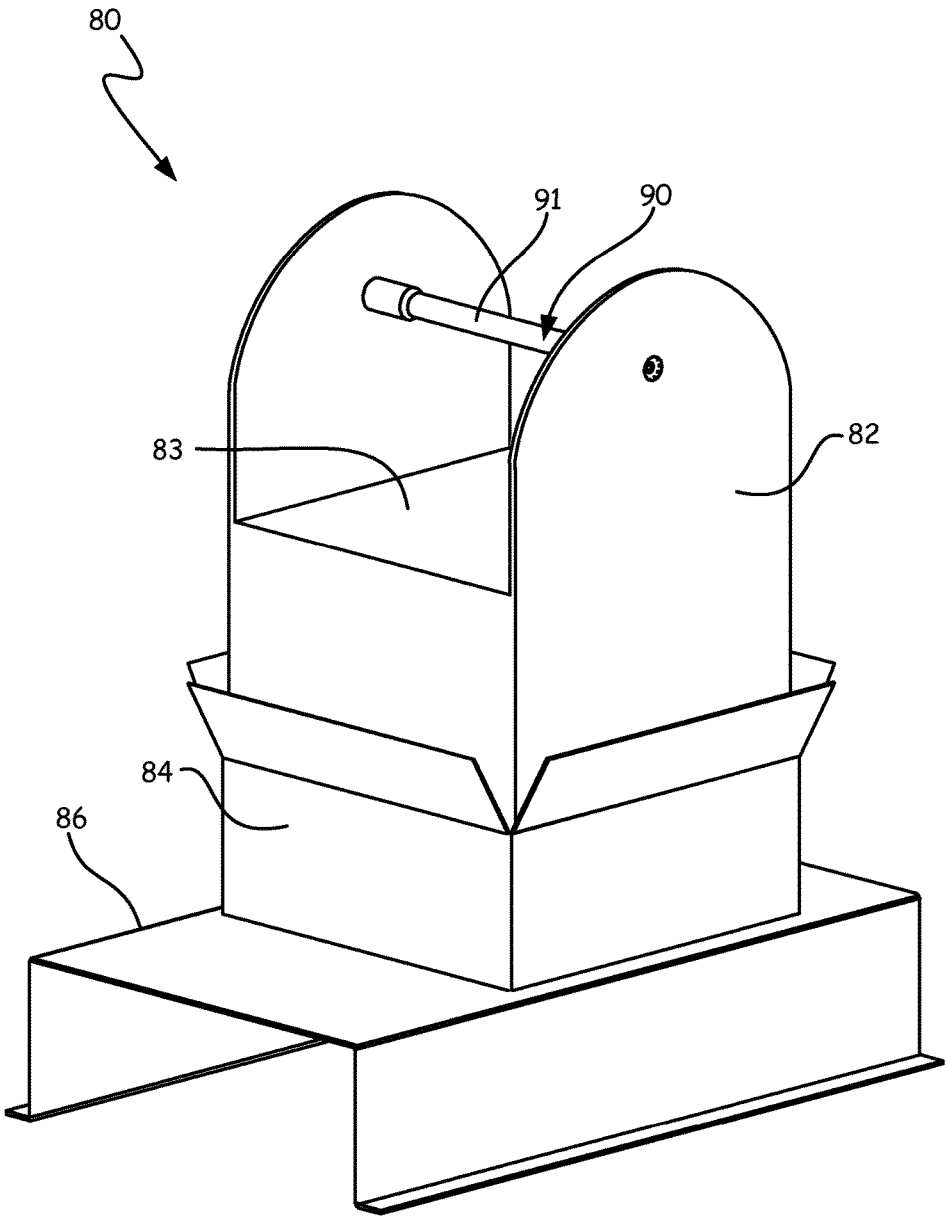
FIG. 4 is a perspective view of a portion of the apparatus of the present invention.
Figure 5:
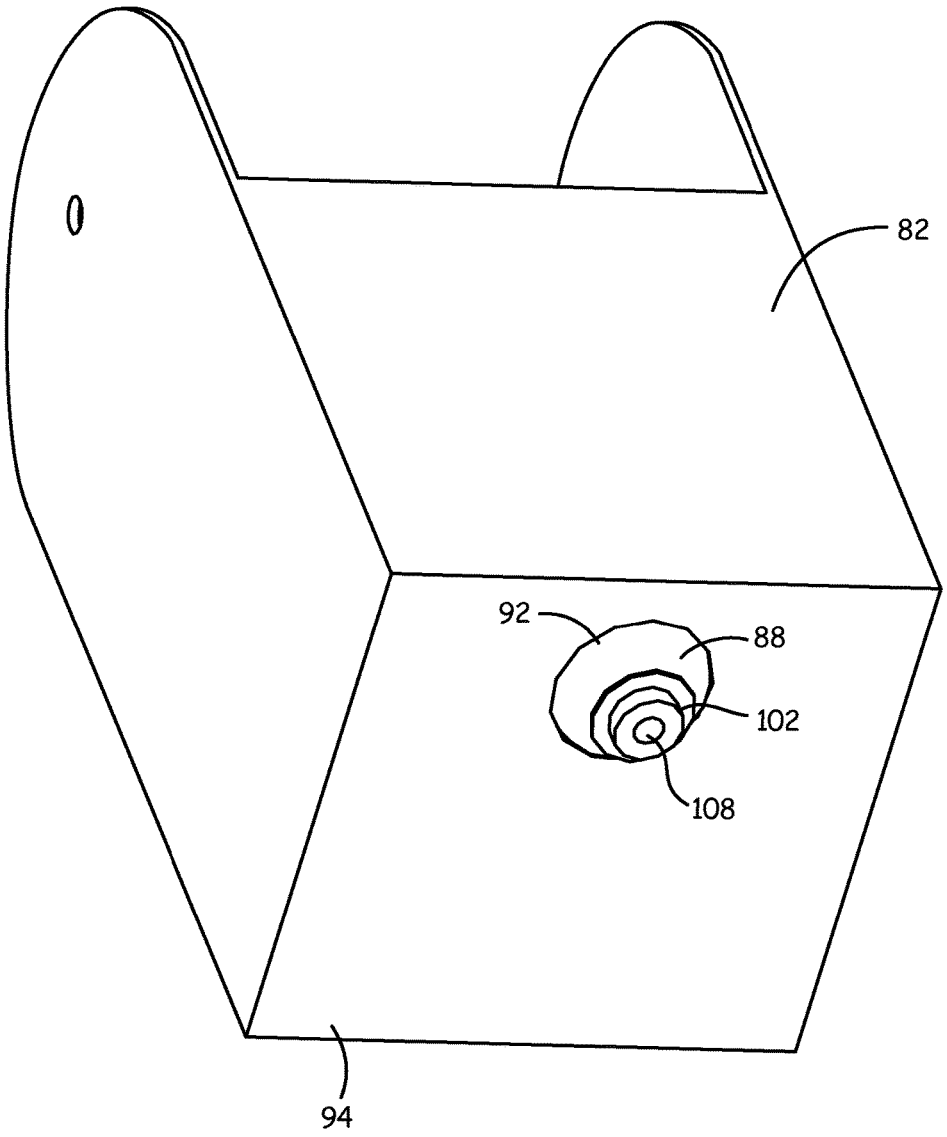
FIG. 5 is a bottom perspective view of a portion of the apparatus illustrated in FIG. 4.

To further facilitate the remote operation of the liquid jet tool, a portable abrasive dispensing apparatus 80 is provided, an example embodiment of which is illustrated in FIG. 4. It is contemplated that portable abrasive dispensing apparatus 80 may be positioned in proximity to the liquid jet tool, so as to minimize the necessary length of any abrasive delivery conduit between an abrasive reservoir and the liquid jet tool. The minimization of the abrasive delivery conduit length may be particularly important in underwater applications involving relatively high external fluid pressures. Minimization of the abrasive delivery conduit length is also desirable to reduce the likelihood of clogging or other problems associated with the delivery of abrasive material, such as in a slurry, to the liquid jet tool.

In the illustrated embodiment, portable abrasive dispensing apparatus 80 includes a tote 82 that is receivable in or engagable with a guide frame 84, which itself is secured to or integrally formed with a mounting bracket 86. Tote 82 may be configured to contain or carry a storage vessel 88 in a chamber 83 of tote 82. Consequently, tote 82 is arranged as a mechanism to transport storage vessel 88 to a location for dispensing abrasive material contained within storage vessel 88.

Tote 82 may be provided in a variety of configurations, but may be specifically configured for reception in or engagement with guide frame 84. Tote 82 may include a handle 90 with a configuration suitable for handling by a human user and/or an ROV. In an example embodiment, handle 90 has a cylindrical central portion 91 with an outer diameter of 0.75 inch, which is a standard grasping handle size commonly employed with implements for ROVs. Thus, an ROV operating, for example, under water may manipulate and transport tote 82 by grasping handle 90.

Tote 82 may further include an aperture 92 through which access to storage vessel 88 disposed in tote chamber 83 may be provided. In the illustrated embodiment, aperture 92 is disposed in bottom wall 94 of tote 82, though it is contemplated that aperture 92 may be disposed in any wall or surface of tote 82. As will be described in greater detail hereinbelow, however, it may be beneficial to provide aperture 92 in a location of tote 82 that permits gravitational dispensation of the abrasive material from storage vessel 88 out through a wall of tote 82. With this consideration in mind, aperture 92 may desirably be disposed in bottom wall 94, or at a lower position of a side wall of tote 82.

Storage vessel 88 may be contained and/or transported in chamber 83 of tote 82, and contains an abrasive material for delivery to the liquid jet tool as an abrasive additive to the liquid jet. In some embodiments, storage vessel 88 may be fabricated from a polymer film of a suitable material and wall thickness for use in a variety of applications, including marine and underwater environments at relatively high external fluid pressures. Storage vessel 88 may include a spout 102 through which abrasive material contained in storage vessel 88 may be dispensed. It is contemplated that aperture 92 in tote 82 be configured to permit spout 102 of storage vessel 88 to protrude out from tote 82 in a manner that will be described hereinbelow. In some embodiments, the abrasive material contained in storage vessel 88 may be a liquidous suspension of solid abrasive particles as the dispersed phase within the liquidous suspending medium as the continuous phase of the suspension. The continuous phase of the abrasive suspension may be water-based, and may initially substantially completely fill storage vessel 88, such that submersion of the filled storage vessel 88 to substantial depths results in substantially equal internal and external fluid pressure on the wall of the storage vessel 88. The equal internal and external fluid pressure minimizes forces placed upon the storage vessel 88, so that storage vessel 88 may be utilized in underwater applications at substantial depths.

Figure 6:
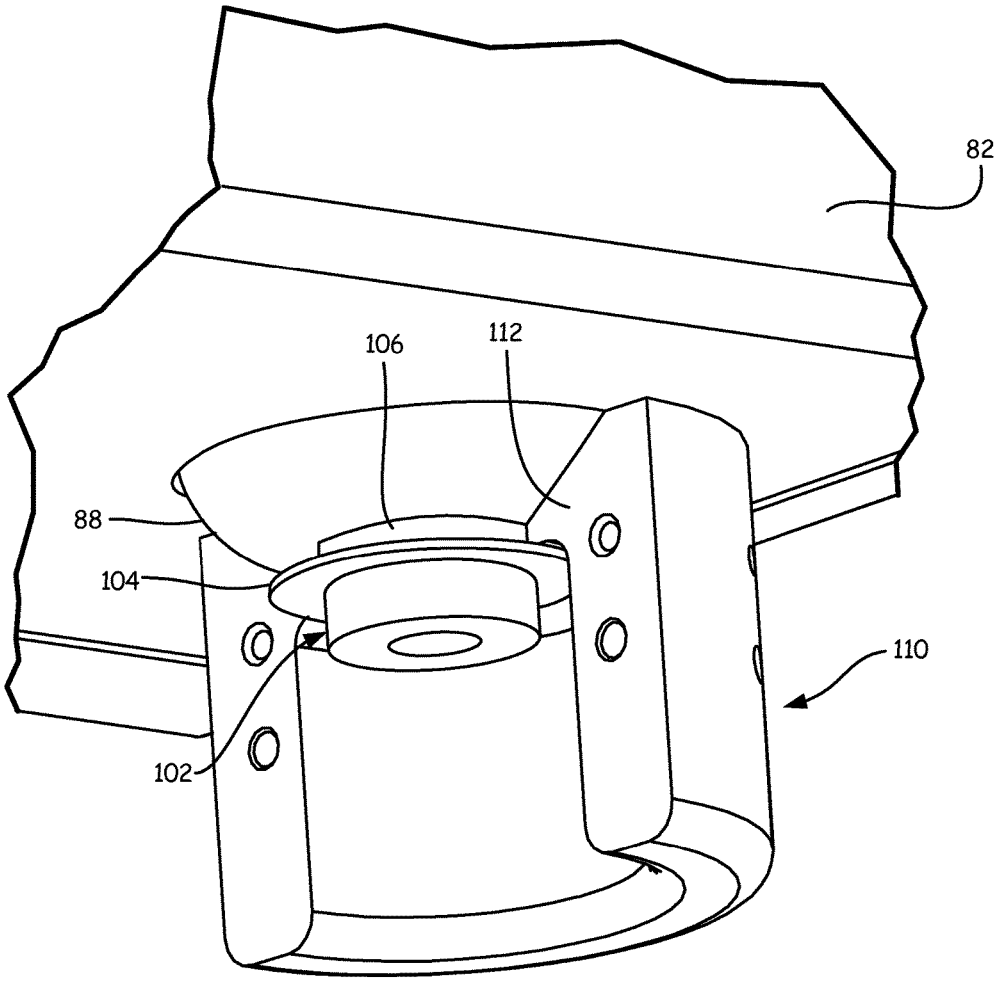
FIG. 6 is a broken away lower perspective view of a portion of the apparatus of the present invention.

An enlarged view of an embodiment of spout 102 is illustrated in FIG. 6, wherein spout 102 includes a flange 104 and an extension portion 106 extending from storage vessel 88. Extension portion 106 provides for a spacing dimension between storage vessel 88 and flange 104, wherein collar 110 may be positioned to grasp flange 104 with a grasping ring 112 between storage vessel 88 and flange 104. Grasping ring 112 of collar 110 holds and orients spout 102 for subsequent dispensation of the abrasive material out through spout opening 108.

Figure 7:
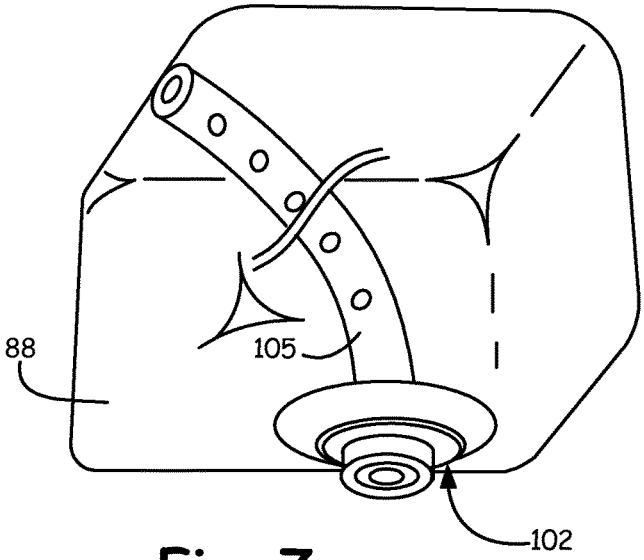
FIG. 7 is a schematic illustration of a portion of the apparatus of the present invention.
Figure 8:
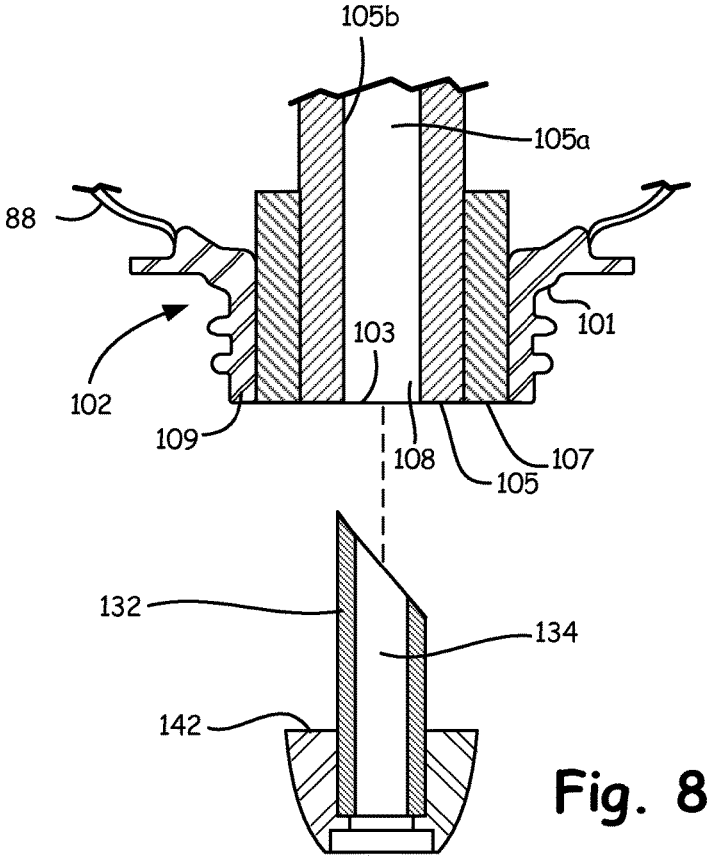
FIG. 8 is a cross-sectional schematic view of a portion of the apparatus of the present invention.
Figure 9:
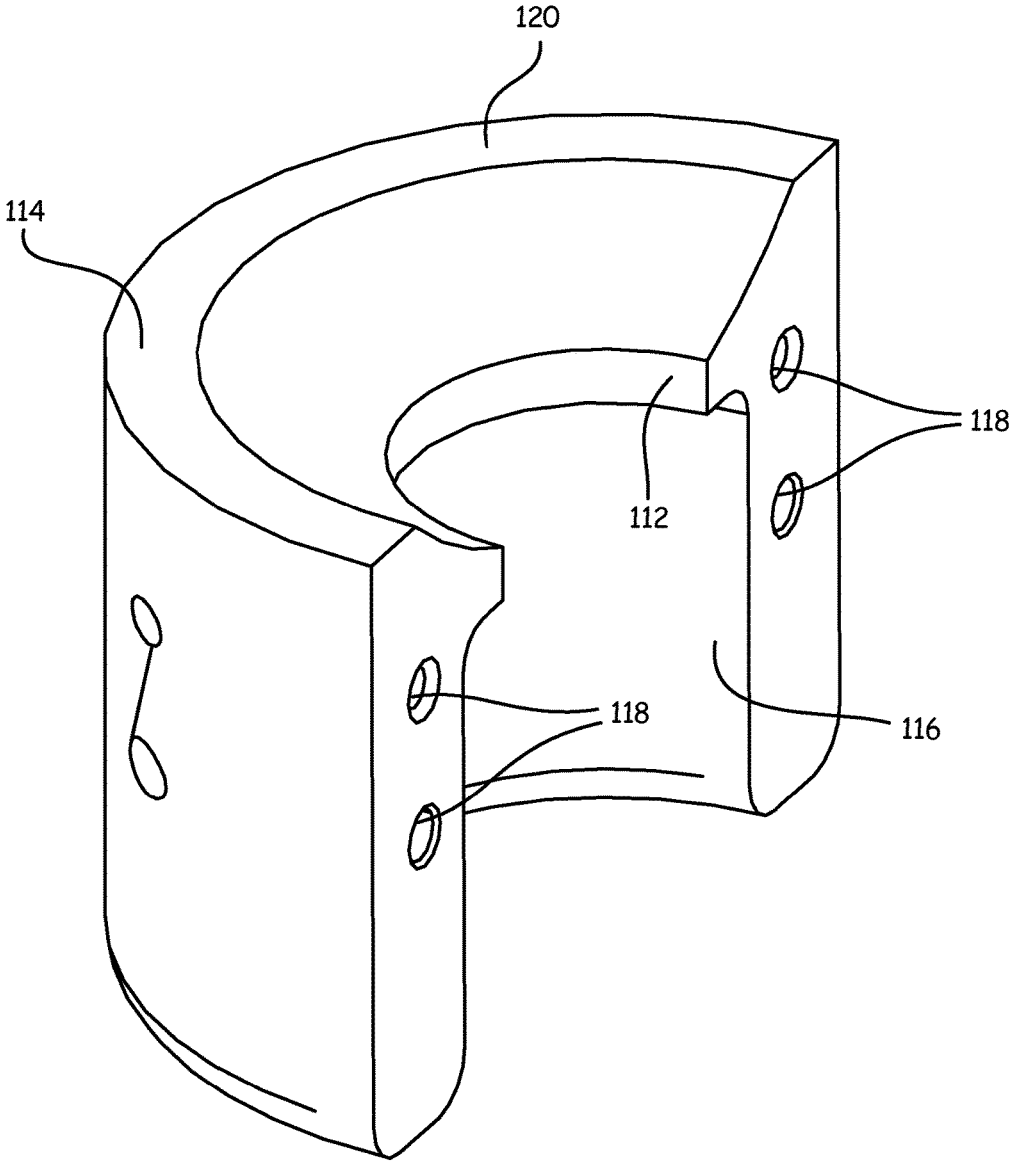
FIG. 9 is a perspective view of a portion of the apparatus of the present invention.
Figure 10:
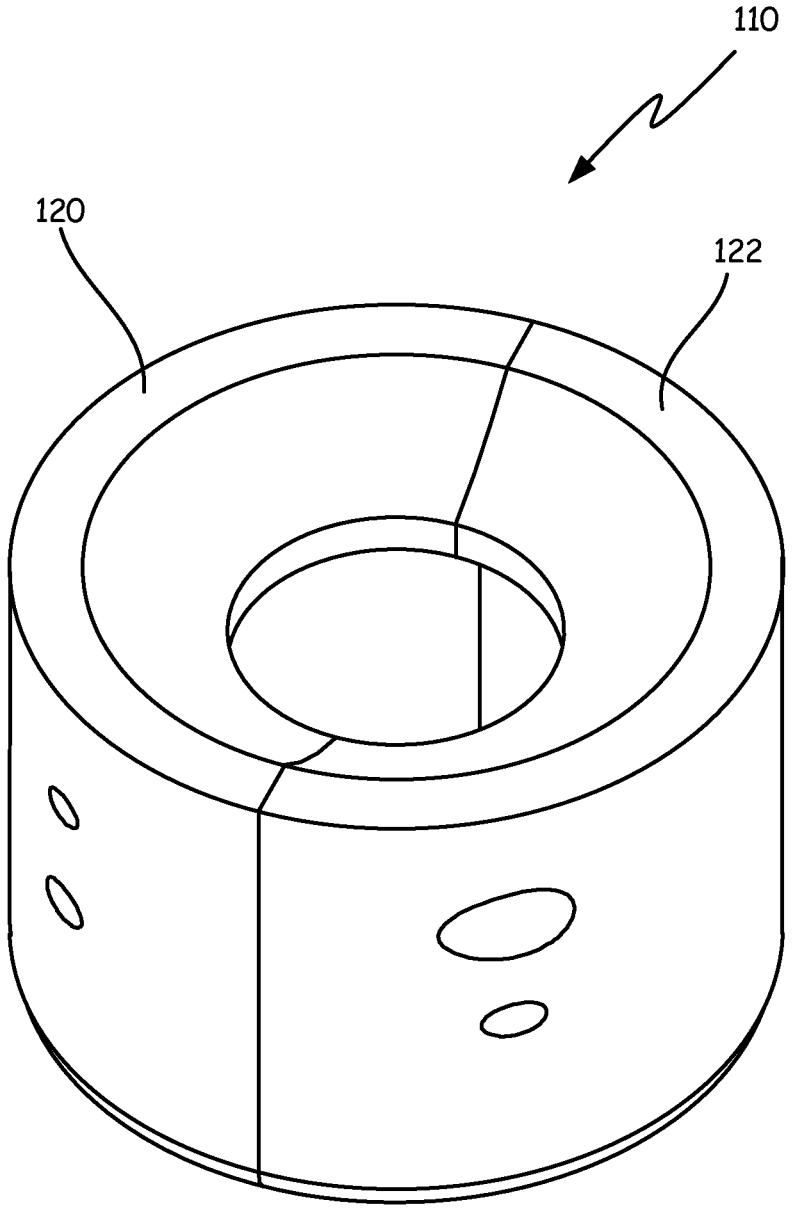
FIG. 10 is a top perspective view of a portion of the apparatus of the present invention.
Figure 11:
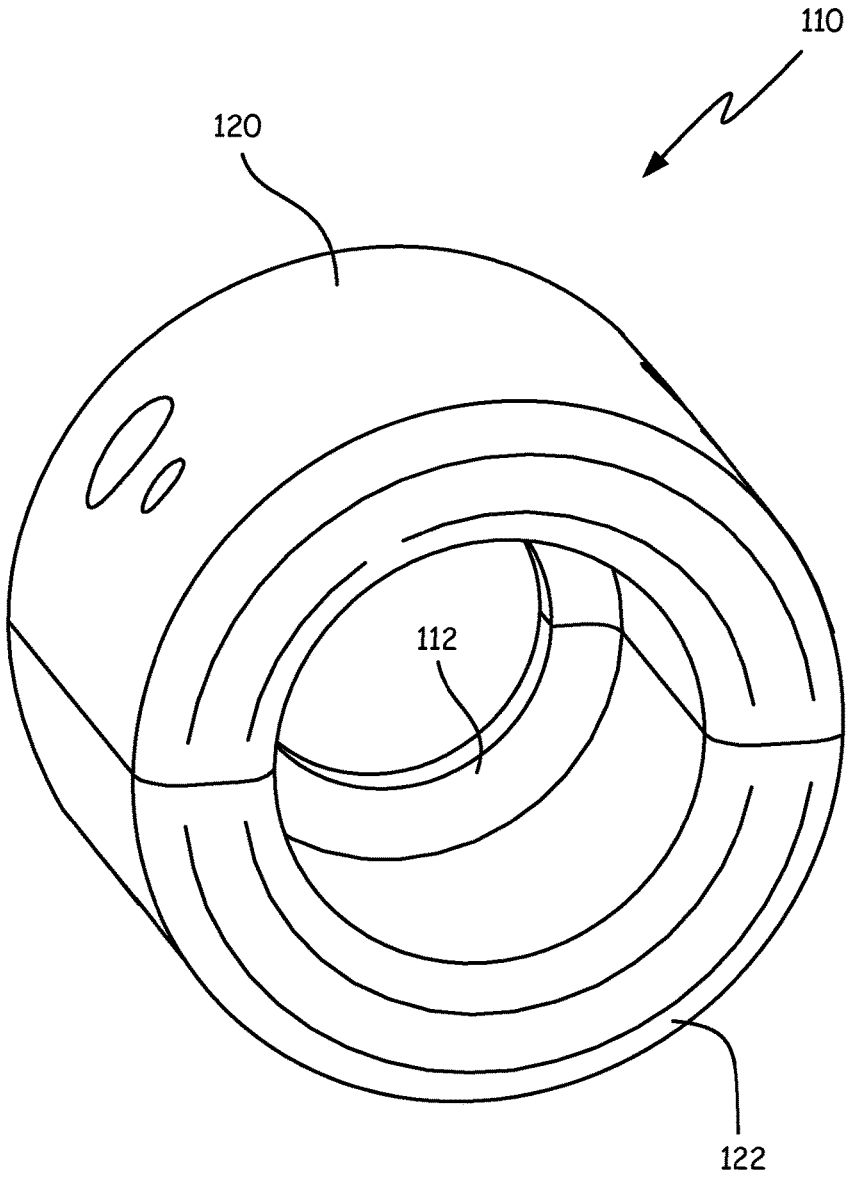
FIG. 11 is a bottom perspective view of the portion of the apparatus illustrated in FIG. 10.
Figure 12:
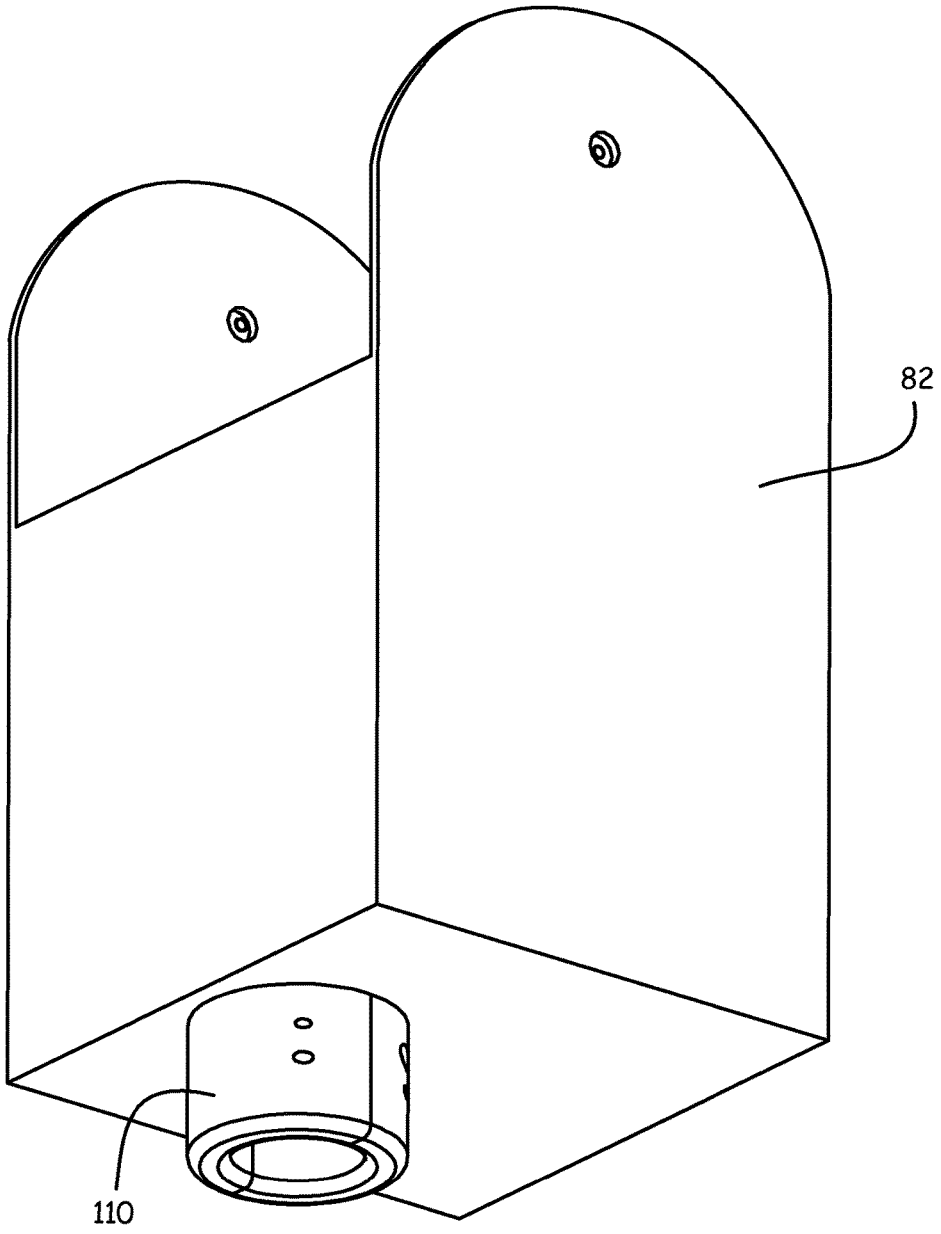
FIG. 12 is a bottom perspective view of a portion of the apparatus of the present invention.

An illustration of the storage vessel and spout assembly is provided in FIGS. 7 and 8, with storage vessel 88 defining a flexible container having a single opening at spout 102. To fully encapsulate the abrasive material disposed in storage vessel 88, a membrane 103 may be placed across spout opening 108 and secured to spout 102 through a suitable bonding technique. A perforated or liquid permeable drainage tube 105 may be provided in storage vessel 88 to assist in the continuous and controlled drainage of the abrasive material out through spout 102. The perforations or other porosity or permeability of drainage tube 105 permits a desirable flow rate of the abrasive material into channel **105*a* defined by the wall of drainage tube 105. A spacer element 107 may be employed between drainage tube 105 and spout fixture 101 to enhance the fluidic seal as between spout fixture 101 and drainage tube 105. To that end, spacer element 107** may be fabricated from a resilient material, such as various vulcanized rubbers or other polymeric materials.

Collar 110 may include first and second collar segments 120, 122 that may define substantially semi-cylindrical segments engagable about extension portion 106 of spout 102 to fully encompass extension portion 106. It is to be understood, however, that various configurations of spout 102 are contemplated by the present invention, such that the configuration of collar 110 preferably corresponds to the configuration of spout 102, so as to capture and retain flange 104 in a desired secured orientation. Grasping ring 112, in addition to establishing a desired secure orientation for spout 102 with respect to storage vessel 88, acts as a solid backstop to inhibit movement of spout 102 toward storage vessel 88, or into tote 82. In its mounted condition, bearing surface 114 operably bears against bottom wall 94 of tote 82. Flange 104 of spout 102 is therefore captured between grasping ring 112 and interior wall surface 116 of collar 110. While flange 104 may not be in continuous intimate contact with any or all of grasping ring 112 and interior wall surface 116 of collar 110, such structures act as movement limiters to generally maintain a desired position and orientation for spout 102 with respect to tote 82.

First and second collar segments 120, 122 may be secured to one another through fasteners or the like through appropriate apertures 118 therein. Collar 110 may be fabricated from a relatively durable and strong material, as well as one that is corrosion resistant and can withstand external fluid pressures of up to, and possibly exceeding 5,000 psi. An example material for collar 110 is stainless steel.

Figure 13:
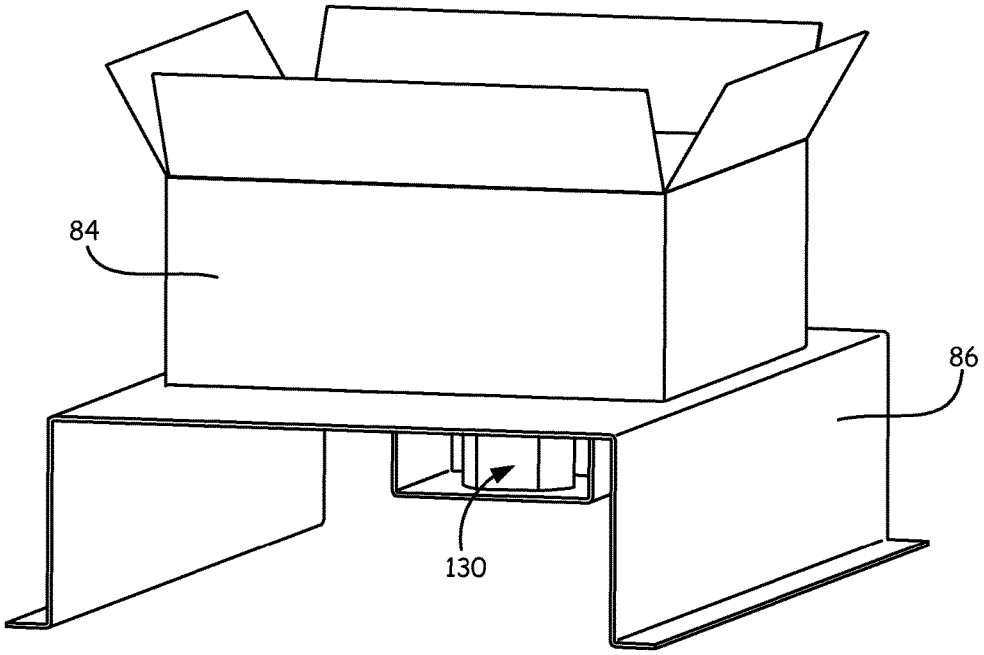
FIG. 13 is a top perspective view of a portion of the apparatus of the present invention.
Figure 14:
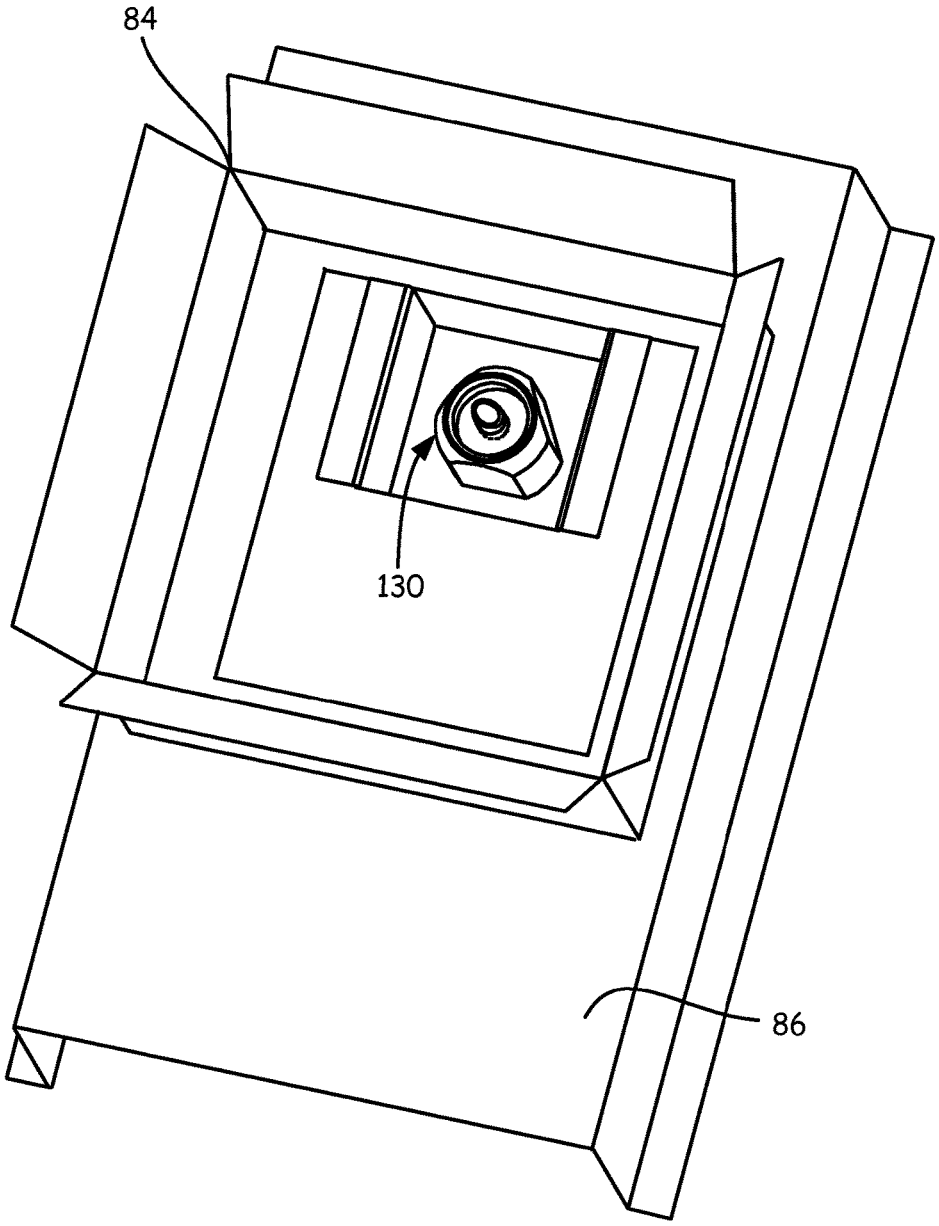
FIG. 14 is a bottom perspective view of the portion of the apparatus illustrated in FIG. 13.
Figure 15:
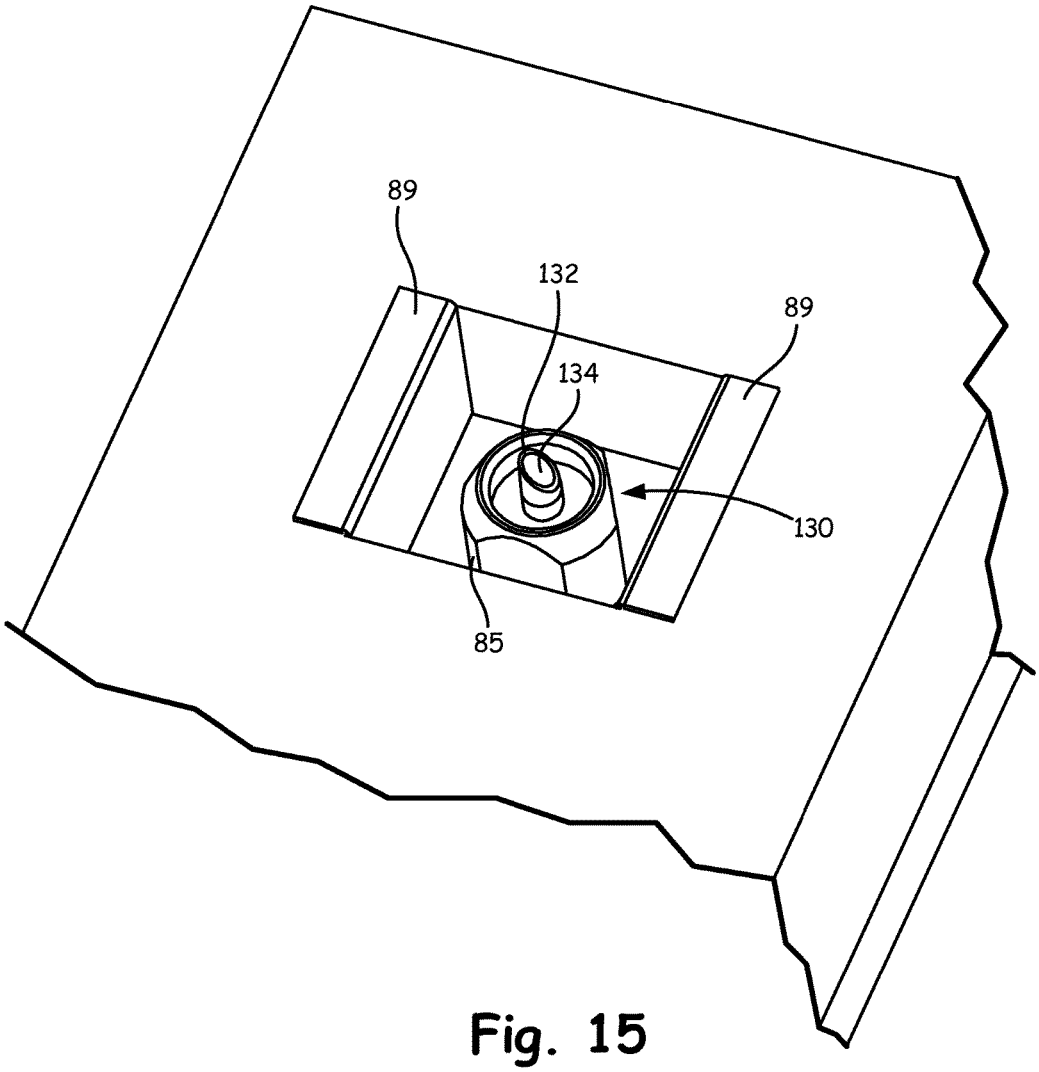
FIG. 15 is an enlarged view of the portion of the apparatus illustrated in FIG. 14.
Figure 16:
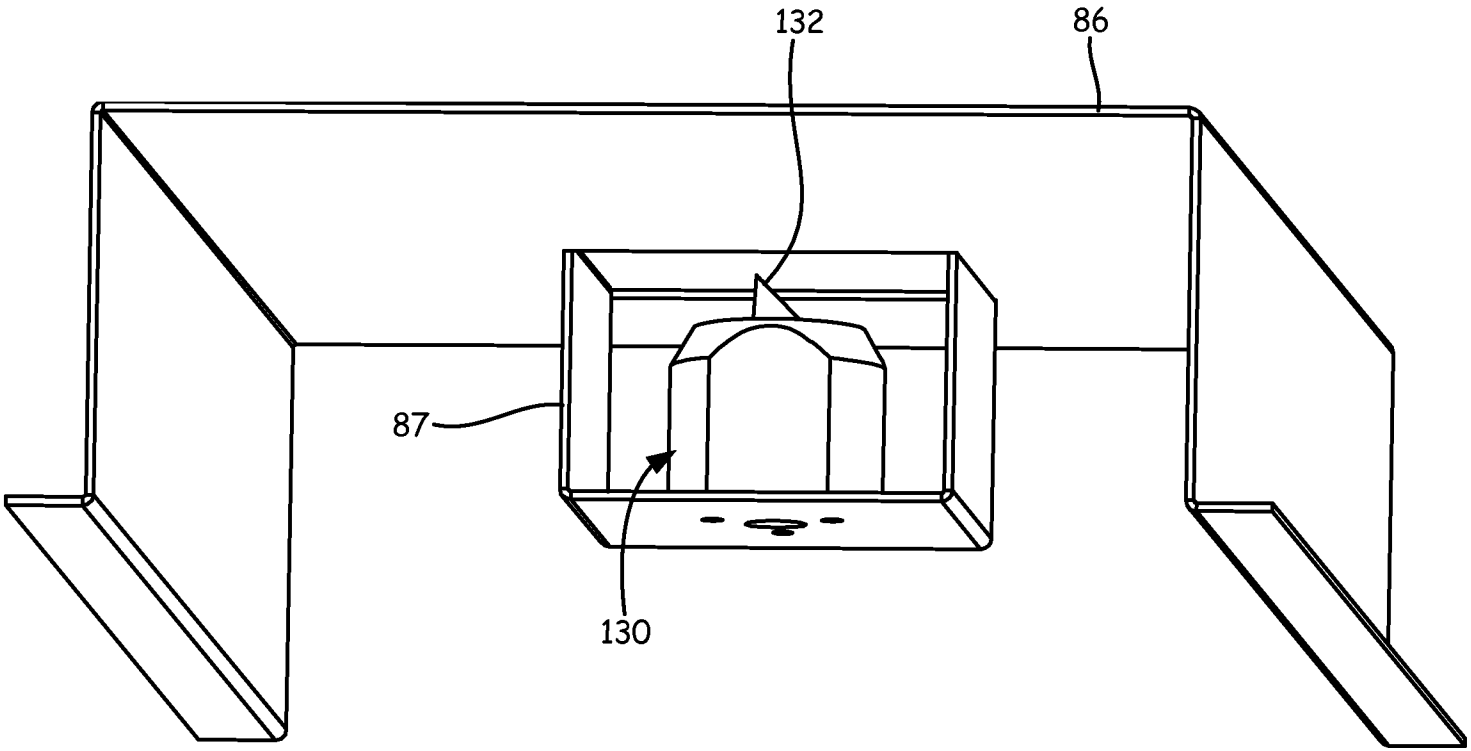
FIG. 16 is a bottom perspective view of a portion of the apparatus of the present invention.
Figure 17:
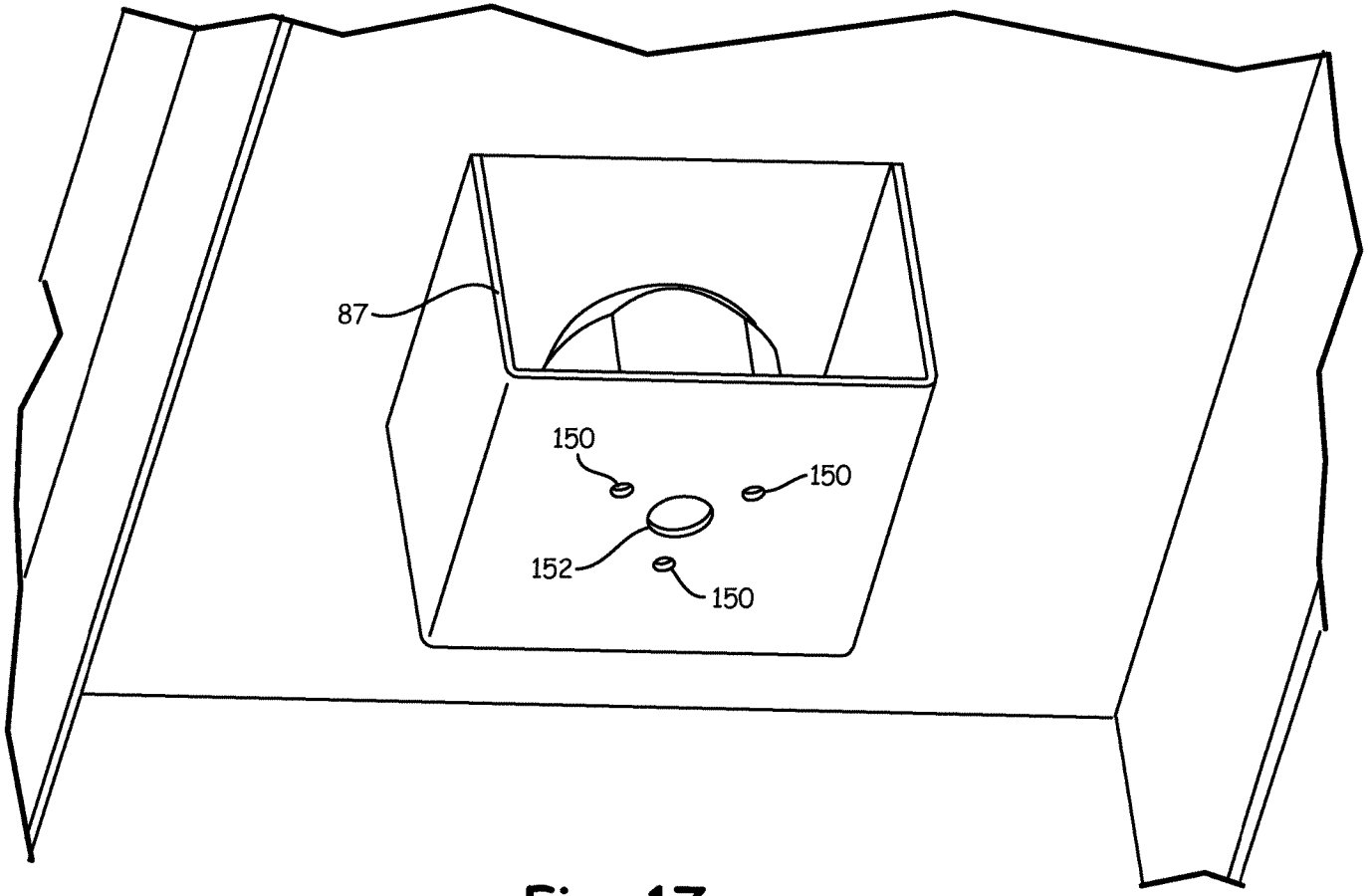
FIG. 17 is a bottom perspective view of the portion of the apparatus illustrated in FIG. 16.
Figure 18:
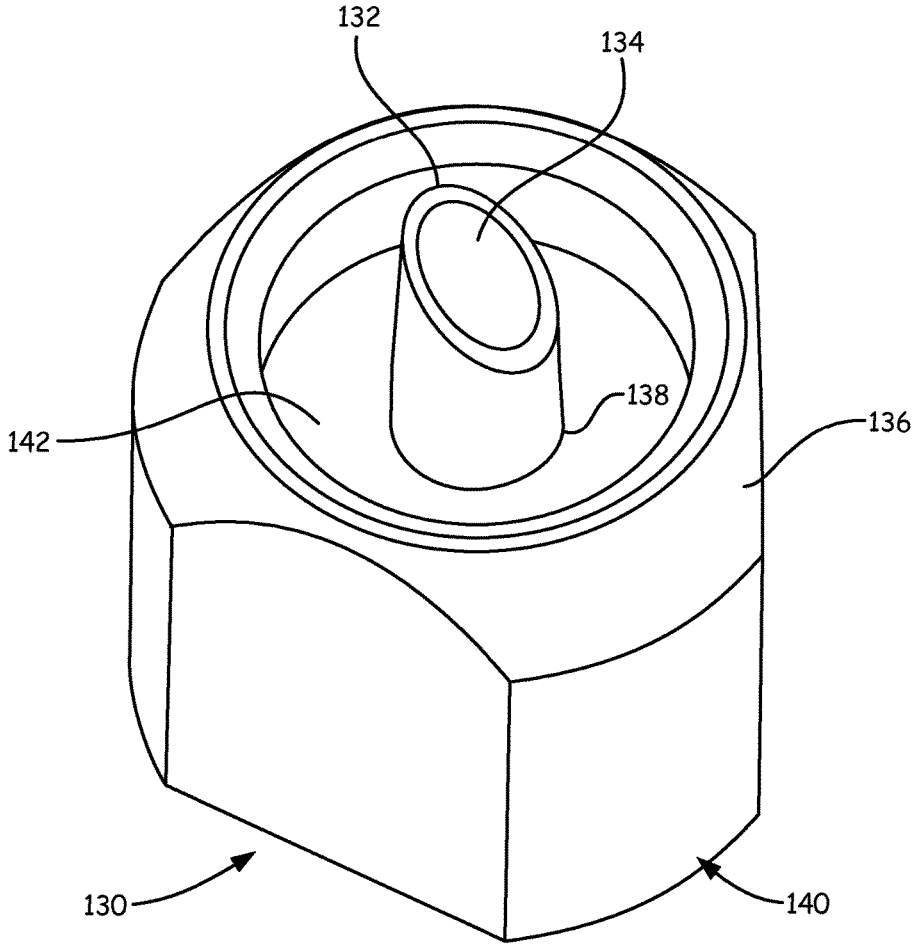
FIG. 18 is a top perspective view of a portion of the apparatus of the present invention.
Figure 19:
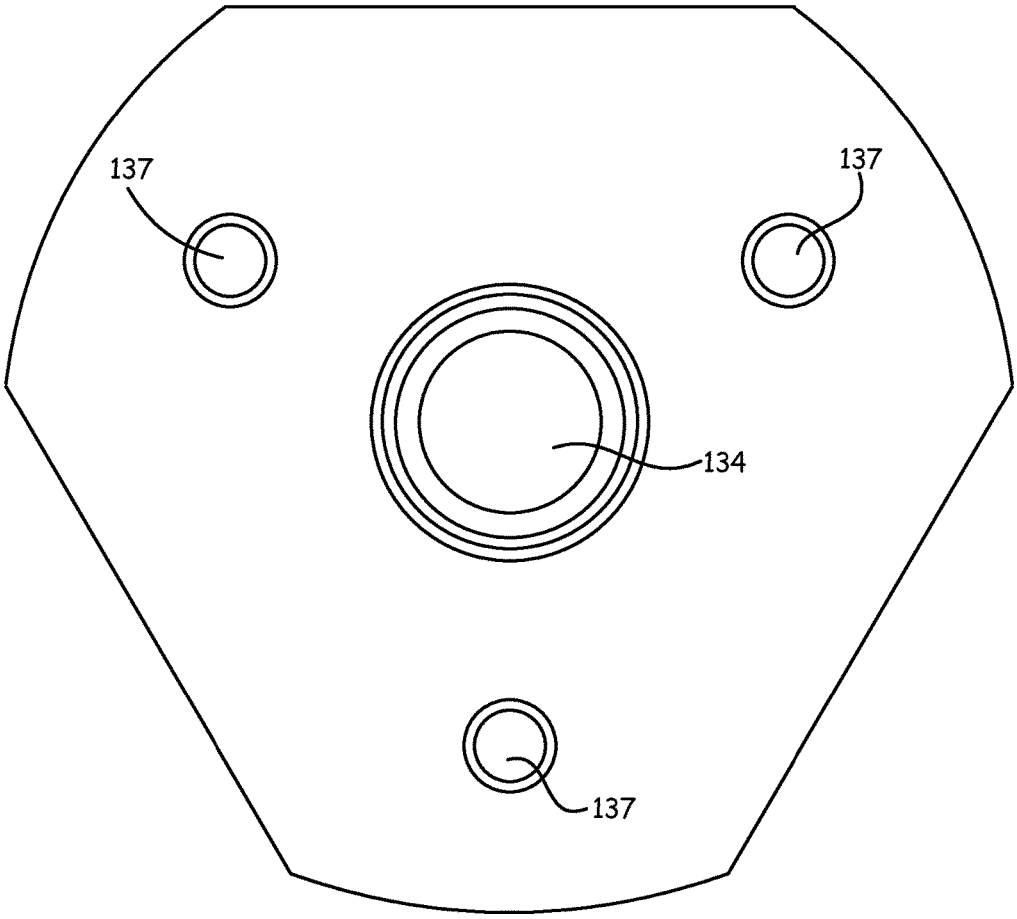
FIG. 19 is a bottom plan view of the portion of the apparatus illustrated in FIG. 18.

Guide frame 83 and mounting bracket 86 are illustrated in isolation in FIG. 13. As indicated above, mounting bracket 86 may be arranged for mounting at or adjacent to the liquid jet tool to receive tote 82 (and storage vessel 88 containing the abrasive material) thereat. It is to be understood that various configurations of guide frame 84 and mounting bracket 86 are contemplated in the present invention, and that one or more of guide frame 84 and mounting bracket 86 may be eliminated from the dispensing apparatus 80 altogether. In the illustrated embodiment, guide frame 84 acts as a guide for orienting and positioning tote 82, such that spout 102 may be brought into alignment with abrasive material conveyance coupling device 130 to permit conveyance of the abrasive material from within storage vessel 88 to the liquid jet tool. As described herein, tote may be received in, or engaged with guide frame 84, or may instead be simply placed at mounting bracket 86 in an orientation axially aligning piercing member 132 of conveyance coupling device 130 with spout opening 108 of spout 102. Guide frame 84 is optionally disposed at mounting bracket 86, and includes one or more walls to facilitate the above described alignment when tote 82 is placed at mounting bracket 86. Conveyance coupling device 130 may be secured to a support bracket 87, which itself is secured to mounting bracket 86. In the illustrated embodiment, support bracket 87 includes flanges 89 secured at an upper surface 86*a* of mounting bracket 86 to suspend support bracket 87 from mounting bracket 86. Support bracket 87 therefore extends through an aperture 85 in mounting bracket 86, wherein conveyance coupling device 130 is disposed below an upper surface of mounting bracket 86. Applicants contemplate, however, a variety of arrangements for securing conveyance coupling device 130 to a structure at or in relative proximity to the liquid jet tool.

Conveyance coupling device 130 defines a conveyance channel 134, which is partially defined as a lumen of piercing member 132. Conveyance coupling device 130 may further include receptacles 137 that may be axially aligned with fastener apertures 150 in support bracket 87 so that conveyance coupling device 130 may be secured to support bracket 87 with fasteners. Other means for securing conveyance coupling device 130 to support bracket 87 are also contemplated by the present invention. Support bracket 87 further includes a passage through which a conveyance member such as a tube 160 or tube fitting may extend to fluidly couple a channel defined by the conveyance member to dispensing channel 134 of conveyance coupling device 130. Piercing member 132 may be integrally formed with knuckle 136 of conveyance coupling device 130, or may instead be press-fit or otherwise secured in an aperture 138 in knuckle 136.

Figure 20:
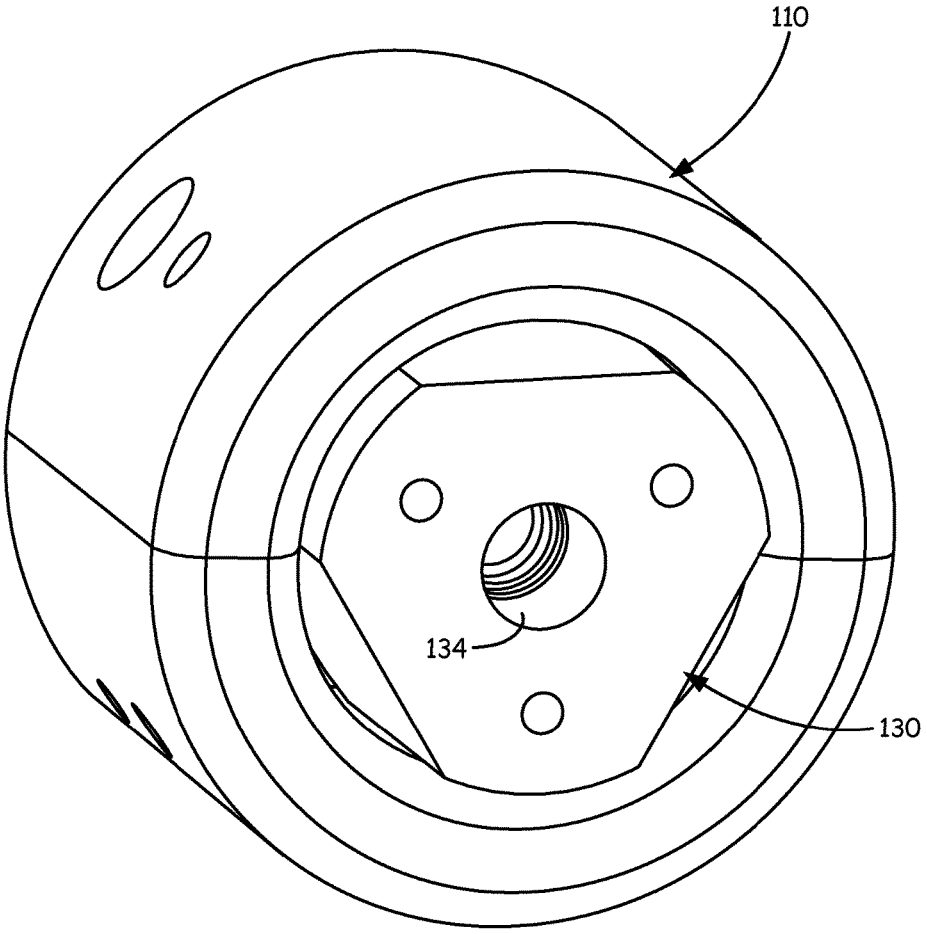
FIG. 20 is a bottom perspective view of a portion of the apparatus of the present invention.
Figure 21:
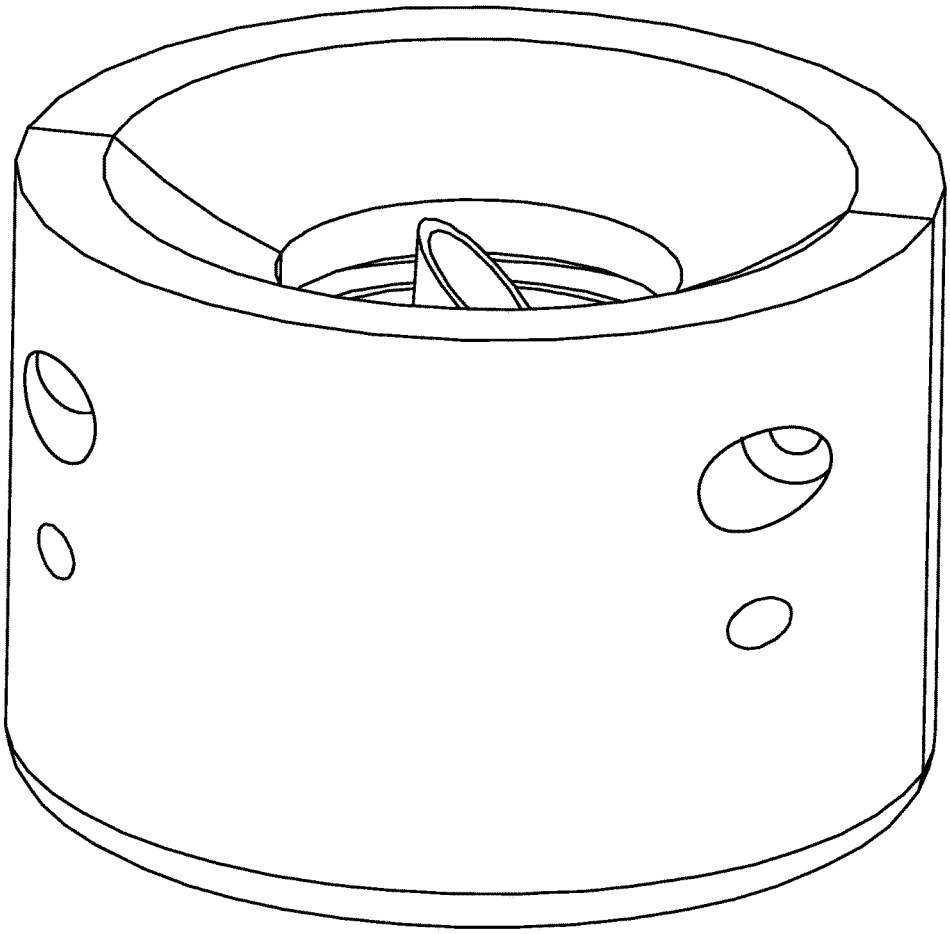
FIG. 21 is a top perspective view of the portion of the apparatus illustrated in FIG. 20.
Figure 22:
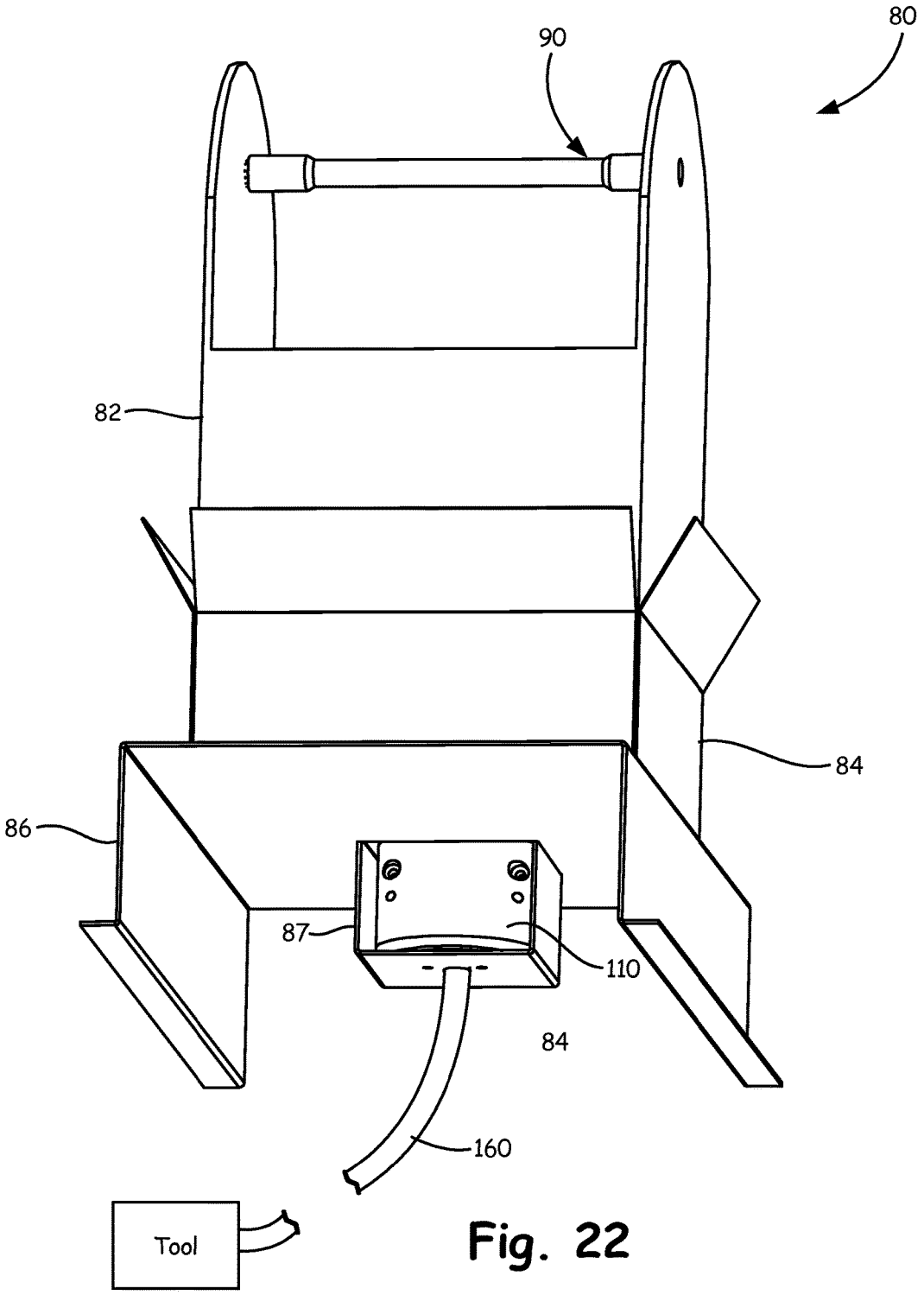
FIG. 22 is a schematic illustration of a portion of the apparatus of the present invention.

Conveyance coupling device 130 may be configured to permit automatic axial alignment of dispensing channel 134 and spout opening 108 of spout 102, such that piercing member 132, upon placement of collar 110 about conveyance coupling device 130, pierces membrane 103 to permit withdrawal of the abrasive material from storage vessel 88 out through spout 102 and into dispensing channel 134 of conveyance coupling device 130. As shown in FIG. 20, interior wall surface 116 of collar 110 may be brought into position about an exterior surface 140 of conveyance coupling device 130 in a closely spaced or engaged relationship to orient and align spout wall end 109 at shoulder surface 142 of conveyance coupling device 130. In particular, the aligning engagement among interior wall surface 116 of collar 110 and exterior surface 140 of conveyance coupling device 130 positions piercing member 132 in axial alignment with spout opening 108, such that piercing member 132 may pierce membrane 103 and sealingly engage with an interior surface 105*b* of drainage tube 105 to permit withdrawal of the abrasive material through dispensing channel 134 of conveyance coupling device 130.

To assist in forming a fluid-tight seal between piercing member 132 and inner surface 105*b* of drainage tube 105, piercing member 132 may be formed with a tapered wall, so that engagement of piercing member 132 within channel 105*a* of drainage tube 105 creates a tight friction fit between piercing member 132 and drainage tube 105. Resilient spacer member 107 further assists in such fluidic seal by maintaining a resiliently radially inwardly-directed force upon drainage tube 105, and to thereby maintain a tight friction fit between drainage tube 105 and piercing member 132.

Once spout 102 is fully depressed downwardly upon conveyance coupling device 130, so as to bring spout and wall 109 into contact with shoulder surface 142 of conveyance coupling device 130, a continuous fluid pathway is established from within storage vessel 88 out through conveyance coupling device 130. A conveyance member 160, such as a tube, may then convey the abrasive material to the liquid jet tool.

As is well known in the art, introduction of abrasive materials to the liquid jet increases the rate at which work pieces may be desirably modified by the liquid jet. The abrasive materials may typically be added to the liquid jet flow downstream from an orifice 302 in the jet tool 300, in a mixing chamber 304, at which point the abrasive material is entrained into the liquid jet flow stream. Upon leaving the mixing chamber, the liquid jet flow stream enters and passes through a nozzle 306 through which the abrasive-ladened flow exits the tool. The nozzle 306 assists in directing the liquid jet along its path toward the work piece.

The portable abrasive dispensing apparatus 80, as described above, permits portable quantities of abrasive material to be brought into proximity to a portable liquid jet tool. The storage vessels 88 containing the abrasive material may be readily interchanged without the use of tools merely by engaging or disengaging spout 102 with conveyance coupling device 130, as guided by collar 110. It is contemplated that discrete packages of tote 82, storage vessel 88, and collar 110 may be prepared and at the ready for removable engagement with conveyance coupling device 130 that is positioned at or in proximity to the liquid jet tool. In such a manner, a first package with a desired quantity of abrasive material may be brought into fluid connection with the liquid jet tool in proximity therewith until the abrasive material has been exhausted from within the storage vessel 88, at which time the exhausted package may be replaced with a distinct separate package of a tote, storage vessel, and collar, with the second package storage vessel being full of abrasive material. It is contemplated that relatively small quantities of abrasive material may be provided in each storage vessel 88, such as an amount appropriate for 30 minutes of discharge of the liquid jet tool under normal operating conditions. Such relatively small quantities limits the weight of the interchangeable packages, so that a human user or ROV is capable of transporting or interchanging the packages as necessary. For the purposes hereof, a "package" may be the combination of a storage vessel and collar 110, and optionally a tote 82. It is further contemplated by the present invention that a plurality of such packages may be disposed at portable liquid jet support unit 12 for the selective use thereof during the operation of the liquid jet tool. The liquid jet tool operator accordingly need only return to the support unit 12 to obtain a "refill" aliquot of abrasive material, and the replacement of an exhausted storage vessel 88 may be accomplished quickly, reliably, and without tools.

A further aspect of the present invention is in the use of a liquidous suspension for the abrasive material contained in the storage vessel 88. Various abrasive material suspensions for use in liquid jet applications have been described. However, the presently proposed suspension is believed to be superior to conventional materials in providing a desirable abrasive particle dispersion, and a somewhat thixotropic rheology profile for maintaining an extended "shelf life" of the dispersed suspension while also being readily dispensable under only the force of a negative pressure potential derived from a vacuum formed by the working liquid passing through the liquid jet tool orifice.

The abrasive suspension of the present invention is preferably supplied to a liquid jet tool from a reservoir, as described above, so as to be entrained in the working liquid jet flow as it is emitted from a nozzle of the liquid jet tool. As is well known in the art, the entrained abrasive particles significantly enhance the effectiveness of the liquid jet on a work piece. Delivery of abrasive particles to the liquid jet in a portable apparatus presents challenges, such as the unavailability of pumps, mixing devices, and the like, not to mention the overall goal of minimization of the equipment necessary to provide an effective liquid jet for portable liquid jet modification of various work pieces. The abrasive suspension of the present invention may therefore be delivered to a work site in a portable container, wherein the suspension is ready for dispensation and use. Accordingly, the abrasive suspension of the present invention preferably exhibits a shelf life of at least 5 days, and more preferably at least 1 month. For the purposes hereof, the term "shelf life" is intended to mean a substantially constant abrasive distribution in the suspension over time, as well as a substantially constant rest viscosity over time. In this manner, once the abrasive suspension is loaded into the portable container, no further action such as agitation, ingredient mixing, or the like is required prior to dispensation to the liquid jet tool.

In addition to the extended shelf life described above, the abrasive suspension of the present invention is preferably dispensable out from its portable container under solely the force of gravity and/or a pressure differential between a pressure within the container (typically approximately atmospheric pressure) and a pressure in a mixing chamber of the liquid jet tool nozzle. Consequently, the abrasive suspension must be flowable under a relatively low driving force so as to be dispensable to the liquid jet tool without the need for an external pumping force. Applicant has discovered that an abrasive suspension with a thixotropic property may aid in the dispensation of a suspension with the presently defined minimum shelf life requirements. A thixotropic fluid requires a period of time to attain an equilibrium viscosity subsequent to exposure to a change in shear rate. Thixotropic materials typically exhibit a stable form at rest, but become less viscous when agitated.

The abrasive suspension of the present invention includes a carrier and an abrasive, wherein the carrier functions to support the composition in a storage stable form, as well as to deliver the composition to a mixing chamber of the liquid jet tool. The carrier may preferably have a density between about 0.6-1.5 g/ml, and more preferably between about 0.8-1.2 g/ml at 20° C. The carrier typically comprises a significant portion of the suspension, typically between 10-90 wt %, with an aspect of the present invention minimizing the carrier concentration in the suspension to maximize abrasive concentration within a storage-stable and flowable composition. While the carrier may be aqueous, organic, or mixtures thereof, the present abrasive suspension most commonly employs an aqueous-based system. The carrier may include materials useful in the suspension, dispensation, and operation of the abrasive suspension.

The abrasive suspension of the present invention may include a mixture of solid abrasive particles, a suspension agent, a rheology modifying agent, and water. In a preferred embodiment, the rheology modifying agent is present in the following concentration ratio with respect to the suspension agent concentration:

$$R=(x\ \%)*(S)$$

Wherein:

R=weight of the rheology modifying agent x=1-10%

S=weight of suspension agent

An example formulation of the suspension is as follows:

| Component | Weight (kilograms) |
|---|---|
| Abrasive Particles | 23 kg |
| Rheology Modifier | 0.075 kg |
| Suspension Agent | 1.35 kg |
| Water | 23.5 kg |

Solid abrasive particles have long been utilized in liquid jet applications, and are well understood in the art. Example abrasive particles useful in the abrasive suspensions of the present invention include naturally occurring abrasives such as calcium carbonite, emery, diamond dust, novaculite, pumice dust, rouge, sand, and garnet. Example artificial abrasives include borazon, ceramic aluminum oxide, ceramic iron oxide, alumina, aluminum oxide, solid CO2, glass powder, steel abrasive, silicon carbide, and zirconia alumina. The various abrasive particles typically range in particle size from 30-220 grit. A particularly useful abrasive particulate material for the present invention may be aluminum oxide at a size range of 40-120 grit.

Various suspension agents, such as methacrylamide and methylcellulose, have been utilized in conventional abrasive suspensions. However, it has been discovered by the applicant that bentonite clay in the concentration ranges described above provide a desirable and long-lasting suspension of the abrasive solid particles in water. For the purposes hereof, the term "bentonite clay" may include potassium bentonite, sodium bentonite, calcium bentonite, and aluminum bentonite. Other clay species, such as illite, montmorillonite and kaolinite may also be usable in the present compositions, through bentonite clay may be particularly preferred. An example dry particle size for the bentonite clay may be a minimum of 65% passing through a 200 mesh sieve (74 microns).

The rheology modifying agents contemplated in the present compositions may provide thixotropic properties, which assists in the flowability of the suspension. Though a variety of rheology modifying agents are contemplated as being useful, certain preferred rheology modifying agents may include xanthan gum, gwar gum, locust bean gum, and lignosulphonates. The nontoxic characteristic of xanthan gum are particularly attractive in the present compositions. CLARIZAN biopolymer, available from Chevron Phillips Corporation, is a clarified, high-viscosity xanthan gum that may be used in most types of water-based fluids where clarity and suspension of the solution is important. The thixotropic property of xanthan gum may be beneficial in the deployment of the present suspension, wherein initial high viscosities may be ameliorated to some extent with a thixotropic agent such as xanthan gum.

A variety of functional additives may further be incorporated with the present compositions. Certain examples include colorants, plasticizers, and biocides. Colorants may be added to one or both of the ultra high pressure liquid feed and the abrasive suspension to indicate and distinguish the flow exiting the liquid jet tool as being either the feed liquid alone or the feed liquid mixed with abrasive. Fluorescein dye is a synthetic organic compound available as a dark orange/red powder, but also available in other colors, and is widely used as a fluorescent tracer. Such dyes may be used in place of, or in addition to colorants as being indicatable under ultraviolet light.

Plasticizers, including "superplasticizers", may be used to aid in the prevention of abrasive particle aggregation, and to improve suspension rheology. Admixtures of a plasticizer such as polycarboxylate ether (PCE) allow substantial water reduction while maintaining desired particle dispersion. Moreover, the use of a plasticizer/superplasticizer may permit an increase to the abrasive particle concentration, which, together with the reduced water concentration, increases the density of the suspension, which may provide modified flowability characteristics desired in certain applications.

Biocides inhibit or kill microorganisms such as bacteria, molds, slimes, and fungi. Organosulfur chemicals, such as methyl 3-mercaptopropionate is an example biocide that may be used to remove foul odors in the abrasive suspension that are the result of bio-organisms. A broad range of mercaptans and organosulfur chemicals are available as biocide additives.

Another useful additive to the present suspension may be water-soluble anionic polyelectrolyte polymers, which are commonly referred to as lignosulfonates. The use of lignosulfonates has been discovered by the Applicant to reduce the viscosity, and to better disperse the abrasive particles in the suspension. As a result, water concentration in the dispersion may be reduced, while abrasive particle concentration may be increased to obtain desired suspension density and flowablity characteristics.

Other functional and non-functional additives are also contemplated as being useful in the present compositions.

Example 1

A batch of abrasive suspension was prepared by premixing 50 pounds of aluminum oxide with 75 grams of xanthan gum and 1350 grams of bentonite clay. Six gallons of fresh water was slowly added to the dry mix under constant stiffing. The mixture was further stirred until a uniform dispersion was formed.

The abrasive suspension was poured into a storage vessel as described above to completely fill the vessel, with an aluminum foil cap being induction sealed at the spout outlet. A tube having a diameter of between a-10 and a-20, and a length of less than about 5 meters was connected to a water jet nozzle with a specific orifice to control the flow rate of the abrasive suspension. Operating the ultra high pressure liquid jet tool generates a low pressure environment sufficient to draw the abrasive suspension out from the storage vessel at a constant rate when the aluminum foil seal is broken, and the contents of the storage vessel are fluidly connected to a portion of the liquid jet tool exhibiting the low pressure environment.

The prepared abrasive suspension is flowable and flows well through a 6 mm inner diameter tube with a 2.5 m length while running the jet tool head pressure at about 65-70 Kpsi. A full 20 lb container of the abrasive suspension provides 30 minutes of cutting or surface modification at the above water jet flow rate. The preparation was effective in making a cut of about 120 inches in length through 0.5 in thick mild steel. A cut rate of 6-7 inches per minute provides a Q5 quality cut, while a cutting rate of 13.5-14 inches per minute provides a Q3-Q4 quality cut.

Example 2

A batch of abrasive suspension was prepared by premixing 5.7 kg of aluminum oxide with 16 g of xanthan gum, 325 g of bentonite clay, and 110 g of lignosulfonate. 5.7 kg of fresh water was slowly added to the dry mix under constant stiffing until a uniform dispersion was formed.

Other blends of these components were prepared in the following concentration ranges:

| Component | Weight Range (kg) |
|---|---|
| Aluminum Oxide | 5.7-11.3 |
| Water | 4.5-5.7 |
| Bentonite Clay | 0.33 |
| Lignosulfonates | 0.11-0.33 |
| Xanthan Gum | 0.016-0.038 |

The abrasive suspension prepared from these components were flowable through a 6 mm inner diameter tube with a 2.5 m length while running the jet tool head pressure at about 65-70 Kpsi.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A method for dispensing an abrasive suspension at a first pressure, said method comprising:

(a) providing a storage vessel containing said abrasive suspension, wherein said abrasive suspension includes a liquidous slurry of:

(i) abrasive particles;

(ii) a suspension agent including a clay;

(iii) a thixotropic rheology modifying agent present in a weight ratio with respect to said suspension agent by:

$$R=(x\ \%)(S)$$

wherein: R is a weight of said thixotropic rheology modifying agent;

S is a weight of said suspension agent; and x=1-10%;

(iv) a lignosulfonate present in a weight ratio with respect to said suspension agent by:

$$L=(y\ \%)(S)$$

Wherein: L is a weight of said lignosulfonate;

S is said weight of said suspension agent; and y=33-100%; and (v) water;

(b) fluidly connecting said abrasive suspension to a chamber of a liquid jet tool; and (c) flowing a liquid stream through said liquid jet tool to create a second pressure in said chamber that is less than said first pressure, wherein said first pressure is ambient pressure, thereby establishing a negative pressure differential that is sufficient to draw said liquidous slurry through the fluid connection to said chamber without supplied positive pressure, the liquidous slurry mixing with the liquid stream at said chamber.

2. A method as in claim 1 wherein said suspension agent includes a bentonite clay.

3. A method in claim 2 wherein said thixotropic rheology modifying agent includes xanthan gum.

* * * * *